US007314531B2

(12) United States Patent
Ishizaka et al.

(10) Patent No.: US 7,314,531 B2
(45) **Date of Patent: *Jan. 1, 2008**

(54) R-T-B SYSTEM RARE EARTH PERMANENT MAGNET

(75) Inventors: Chikara Ishizaka, Tokyo (JP); Gouichi Nishizawa, Tokyo (JP); Tetsuya Hidaka, Tokyo (JP); Akira Fukuno, Tokyo (JP); Yoshinori Fujikawa, Tokyo (JP)

(73) Assignee: TDK Corporation, Tokyo (JP)

( * ) Notice: Subject to any disclaimer, the term of this patent is extended or adjusted under 35 U.S.C. 154(b) by 186 days.

This patent is subject to a terminal disclaimer.

(21) Appl. No.: 10/799,153

(22) Filed: Mar. 11, 2004

(65) Prior Publication Data

US 2004/0187969 A1 Sep. 30, 2004

(30) Foreign Application Priority Data

Mar. 28, 2003 (JP) ..... 2003-092891

(51) Int. Cl.
*H01F 1/057* (2006.01)

(52) U.S. Cl. ..... 148/302; 75/244

(58) Field of Classification Search ..... None
See application file for complete search history.

(56) References Cited

U.S. PATENT DOCUMENTS

| | | | | |
|---|---|---|---|---|
| 6,468,365 | B1 * | 10/2002 | Uchida et al. | 148/302 |
| 6,811,620 | B2 * | 11/2004 | Ishizaka et al. | 148/302 |
| 2002/0003006 | A1 * | 1/2002 | Nishimoto et al. | 148/102 |
| 2002/0007875 | A1 * | 1/2002 | Yamamoto et al. | 148/302 |
| 2002/0017340 | A1 | 2/2002 | Hirota et al. | |
| 2002/0112785 | A1 * | 8/2002 | Sekine et al. | 148/302 |
| 2004/0118484 | A1 * | 6/2004 | Nishizawa et al. | 148/302 |
| 2004/0187969 | A1 * | 9/2004 | Ishizaka et al. | 148/302 |
| 2004/0187970 | A1 * | 9/2004 | Ishizaka et al. | 148/302 |

FOREIGN PATENT DOCUMENTS

| | | |
|---|---|---|
| JP | 01-219143 | 9/1989 |
| JP | 07-176414 | 7/1995 |
| JP | 10-064712 | 3/1998 |
| JP | 2000-234151 | 8/2000 |
| JP | 2002-075717 | 3/2002 |
| JP | 2002-164239 | 6/2002 |

* cited by examiner

*Primary Examiner*—John P. Sheehan
(74) *Attorney, Agent, or Firm*—Hogan & Hartson LLP

(57) ABSTRACT

A sintered body comprising a main phase consisting of an $R_2T_{14}B$ phase (wherein R represents one or more rare earth elements (providing that the rare earth elements include Y), and T represents one or more transition metal elements essentially containing Fe, or Fe and Co), and a grain boundary phase containing a higher amount of R than the main phase, wherein a platy or acicular product exists. This sintered body enables to inhibit the grain growth, while keeping a decrease in magnetic properties to a minimum, and to improve a suitable sintering temperature range.

8 Claims, 24 Drawing Sheets

FIG. 10

| TYPE | | Nd (wt%) | Pr (wt%) | Dy (wt%) | Co (wt%) | Cu (wt%) | Al (wt%) | B (wt%) | Zr (wt%) | Fe |
|---|---|---|---|---|---|---|---|---|---|---|
| A | LOW R ALLOY | 23.6 | 6.0 | 0.3 | — | 0.05 | 0.23 | 1.1 | 0.11 | bal. |
| | HIGH R ALLOY | 40.6 | — | — | 5.0 | 0.05 | 0.23 | — | — | bal. |
| | COMPOSITION OF SINTERED BODY | 25.0 | 5.3 | 0.3 | 0.5 | 0.05 | 0.23 | 1.0 | 0.10 | bal. |
| B | LOW R ALLOY | 23.6 | 6.0 | 0.3 | — | 0.05 | 0.23 | 1.1 | — | bal. |
| | HIGH R ALLOY | 40.6 | — | — | 5.0 | 0.05 | 0.23 | 0.5 | 2.0 | bal. |
| | COMPOSITION OF SINTERED BODY | 25.0 | 5.3 | 0.3 | 0.5 | 0.05 | 0.23 | 1.1 | 0.10 | bal. |
| C | LOW R ALLOY | 23.6 | 6.0 | 0.3 | — | 0.05 | 0.23 | 1.1 | — | bal. |
| | HIGH R ALLOY | 40.6 | — | — | 5.0 | 0.05 | 0.23 | — | — | bal. |
| | COMPOSITION OF SINTERED BODY | 25.0 | 5.3 | 0.3 | 0.5 | 0.05 | 0.23 | 1.0 | — | bal. |

FIG. 15

| TYPE | Zr ADDING METHOD | Zr ADDITIVE AMOUNT [wt%] | $O_2$ [ppm] | $N_2$ [ppm] | SIZE OF PRODUCT (AVERAGE) | | | SINTERING TEMPERATURE [°C] | Br [kG] | HcJ [kOe] | Hk/HcJ [%] |
|---|---|---|---|---|---|---|---|---|---|---|---|
| | | | | | MAJOR AXIS [nm] | MINOR AXIS [nm] | AXIS RATIO | | | | |
| A | LOW R ALLOYS | 0.1 | 670 | 350 | 310 | 15 | 22.7 | 1010 | 13.81 | 12.56 | 86.3 |
| | | | | | | | | 1030 | 13.92 | 13.26 | 96.1 |
| | | | | | | | | 1050 | 13.93 | 13.52 | 97.0 |
| | | | | | | | | 1070 | 13.95 | 13.62 | 96.3 |
| | | | | | | | | 1090 | 13.90 | 13.42 | 96.0 |
| B | HIGH R ALLOYS | | 850 | 300 | 166 | 15 | 11.2 | 1010 | 13.84 | 12.24 | 86.3 |
| | | | | | | | | 1030 | 13.85 | 12.34 | 88.7 |
| | | | | | | | | 1050 | 13.87 | 13.20 | 91.5 |
| | | | | | | | | 1070 | 13.90 | 13.18 | 90.1 |
| | | | | | | | | 1090 | 13.75 | 12.56 | 75.3 |
| C | — | 0 | 720 | 320 | NO PRODUCT GENERATED | | | 1010 | 13.85 | 11.87 | 84.2 |
| | | | | | | | | 1030 | 13.91 | 12.22 | 85.6 |
| | | | | | | | | 1050 | 13.93 | 13.15 | 88.7 |
| | | | | | | | | 1070 | 14.03 | 12.92 | 51.7 |
| | | | | | | | | 1090 | 14.01 | 12.13 | 39.1 |

FIG. 21

| TYPE | | Nd (wt%) | Pr (wt%) | Dy (wt%) | Co (wt%) | Cu (wt%) | Al (wt%) | B (wt%) | Zr (wt%) | Fe |
|---|---|---|---|---|---|---|---|---|---|---|
| D | LOW R ALLOY | 23.6 | 6.0 | 0.3 | – | 0.05 | 0.23 | 1.1 | 0.12 | bal. |
| | HIGH R ALLOY | 40.6 | – | – | 5.0 | 0.05 | 0.23 | – | – | bal. |
| | COMPOSITION OF SINTERED BODY | 25.0 | 5.3 | 0.3 | 0.5 | 0.05 | 0.23 | 1.0 | 0.11 | bal. |
| E | LOW R ALLOY | 23.6 | 5.7 | 0.4 | — | 0.05 | 0.18 | 1.1 | 0.15 | bal. |
| | HIGH R ALLOY | 40.6 | – | – | 5.0 | 0.05 | 0.23 | – | – | bal. |
| | COMPOSITION OF SINTERED BODY | 25.0 | 5.1 | 0.4 | 0.5 | 0.05 | 0.19 | 1.0 | 0.15 | bal. |
| F | LOW R ALLOY | 22.5 | 6.2 | 1.2 | — | 0.05 | 0.23 | 1.1 | 0.20 | bal. |
| | HIGH R ALLOY | 40.6 | – | – | 5.0 | 0.05 | 0.23 | – | — | bal. |
| | COMPOSITION OF SINTERED BODY | 24.0 | 5.6 | 1.1 | 0.5 | 0.05 | 0.23 | 1.0 | 0.18 | bal. |
| G | LOW R ALLOY | 22.7 | 5.0 | 1.5 | — | 0.05 | 0.23 | 1.1 | 0.16 | bal. |
| | HIGH R ALLOY | 34.3 | – | 6.0 | 5.0 | 0.05 | 0.15 | – | — | bal. |
| | COMPOSITION OF SINTERED BODY | 23.9 | 4.5 | 2.0 | 0.5 | 0.05 | 0.22 | 1.0 | 0.15 | bal. |

FIG. 22

| TYPE | $O_2$ [ppm] | $N_2$ [ppm] | SINTERING TEMPERATURE [°C] | Br [kG] | HcJ [kOe] | Hk/HcJ [%] | Br+0.1×HcJ [DIMENSIONLESS] | SIZE OF PRODUCT (AVERAGE) | | |
|---|---|---|---|---|---|---|---|---|---|---|
| | | | | | | | | MAJOR AXIS [nm] | MINOR AXIS [nm] | AXIS RATIO |
| D | 620 | 440 | 1010 | 14.35 | 10.83 | 88.6 | 15.4 | 280 | 13 | 18.8 |
| | | | 1030 | 14.36 | 14.31 | 95.0 | 15.8 | | | |
| | | | 1050 | 14.44 | 14.28 | 97.0 | 15.9 | | | |
| | | | 1070 | 14.44 | 13.15 | 95.2 | 15.8 | | | |
| | | | 1090 | 14.52 | 10.96 | 44.0 | 14.9 | | | |
| E | 580 | 380 | 1010 | 14.33 | 11.55 | 88.0 | 15.5 | 330 | 15 | 23.1 |
| | | | 1030 | 14.40 | 14.37 | 95.6 | 15.8 | | | |
| | | | 1050 | 14.30 | 14.41 | 96.4 | 15.9 | | | |
| | | | 1070 | 14.43 | 14.05 | 97.5 | 15.8 | | | |
| | | | 1090 | 14.38 | 13.22 | 96.0 | 15.7 | | | |
| F | 870 | 420 | 1010 | 14.18 | 13.51 | 87.3 | 15.5 | 410 | 18 | 24.4 |
| | | | 1030 | 14.27 | 15.37 | 95.3 | 15.7 | | | |
| | | | 1050 | 14.28 | 15.42 | 96.1 | 15.8 | | | |
| | | | 1070 | 14.28 | 15.40 | 98.2 | 15.8 | | | |
| | | | 1090 | 14.28 | 15.31 | 97.9 | 15.7 | | | |
| G | 550 | 360 | 1010 | 13.90 | 15.31 | 95.6 | 15.4 | 300 | 15 | 21.9 |
| | | | 1030 | 13.90 | 17.07 | 97.8 | 15.6 | | | |
| | | | 1050 | 13.90 | 17.18 | 97.9 | 15.6 | | | |
| | | | 1070 | 13.91 | 17.22 | 97.8 | 15.6 | | | |
| | | | 1090 | 13.92 | 16.83 | 72.1 | 15.6 | | | |

FIG. 23

| TYPE | | Nd [wt%] | Pr [wt%] | Dy [wt%] | Co [wt%] | Cu [wt%] | Al [wt%] | B [wt%] | Zr [wt%] | $O_2$ [ppm] | $N_2$ [ppm] | Fe |
|---|---|---|---|---|---|---|---|---|---|---|---|---|
| H | LOW R ALLOY | 27.9 | – | 0.1 | — | 0.03 | 0.05 | 1.1 | 0.08 | — | — | bal. |
| | HIGH R ALLOY | 35.1 | – | – | 2.0 | 0.03 | 0.05 | – | — | — | — | bal. |
| | COMPOSITION OF SINTERED BODY | 28.3 | – | 0.1 | 0.2 | 0.03 | 0.05 | 1.0 | 0.07 | 720 | 360 | bal. |
| I | LOW R ALLOY | 23.7 | 6.0 | 0.2 | — | 0.30 | 0.25 | 1.6 | 0.30 | — | — | bal. |
| | HIGH R ALLOY | 40.6 | — | – | 20.0 | 0.30 | 0.25 | — | — | — | — | bal. |
| | COMPOSITION OF SINTERED BODY | 26.9 | 4.8 | 0.2 | 4.0 | 0.30 | 0.25 | 1.3 | 0.24 | 980 | 450 | bal. |

FIG. 24

| TYPE | Br [kG] | HcJ [kOe] | Hk/HcJ [%] |
|---|---|---|---|
| H | 14.62 | 13.10 | 98.0 |
| I | 13.88 | 15.30 | 96.0 |
| D | 14.44 | 13.15 | 95.2 |
| E | 14.43 | 14.05 | 97.5 |
| F | 14.28 | 15.40 | 98.2 |
| G | 13.91 | 17.22 | 97.8 |

R-T-B SYSTEM RARE EARTH PERMANENT MAGNET

BACKGROUND OF THE INVENTION

1. Field of the Invention

The present invention relates to a method for manufacturing an R-T-B system rare earth permanent magnet containing, as main components, R (wherein R represents one or more rare earth elements, providing that the rare earth elements include Y), T (wherein T represents at least one transition metal element essentially containing Fe, or Fe and Co), and B (boron).

2. Description of the Related Art

Among rare earth permanent magnets, an R-T-B system rare earth permanent magnet has been increasingly demanded year by year for the reasons that its magnetic properties are excellent and that its main component Nd is abundant as a source and relatively inexpensive.

Research and development directed towards the improvement of the magnetic properties of the R-T-B system rare earth permanent magnet have intensively progressed. For example, Japanese Patent Laid-Open No. 1-219143 discloses that the addition of 0.02 to 0.5 at % of Cu improves magnetic properties of the R-T-B system rare earth permanent magnet as well as heat treatment conditions. However, the method described in Japanese Patent Laid-Open No. 1-219143 is insufficient to obtain high magnetic properties required of a high performance magnet, such as a high coercive force (HcJ) and a high residual magnetic flux density (Br).

The magnetic properties of an R-T-B system rare earth permanent magnet obtained by sintering depend on the sintering temperature. On the other hand, it is difficult to equalize the heating temperature throughout all parts of a sintering furnace in the scale of industrial manufacturing. Thus, the R-T-B system rare earth permanent magnet is required to obtain desired magnetic properties even when the sintering temperature is changed. A temperature range in which desired magnetic properties can be obtained is referred to as a suitable sintering temperature range herein.

In order to obtain a higher-performance R-T-B system rare earth permanent magnet, it is necessary to decrease the amount of oxygen contained in alloys. However, if the amount of oxygen contained in the alloys is decreased, abnormal grain growth is likely to occur in a sintering process, resulting in a decrease in a squareness. This is because oxides formed by oxygen contained in the alloys inhibit the grain growth.

Thus, a method of adding a new element to the R-T-B system rare earth permanent magnet containing Cu has been studied as means for improving the magnetic properties. Japanese Patent Laid-Open No. 2000-234151 discloses the addition of Zr and/or Cr to obtain a high coercive force and a high residual magnetic flux density.

Likewise, Japanese Patent Laid-Open No. 2002-75717 discloses a method of uniformly dispersing a fine ZrB compound, NbB compound or HfB compound (hereinafter referred to as an M-B compound) into an R-T-B system rare earth permanent magnet containing Zr, Nb or Hf as well as Co, Al and Cu, followed by precipitation, so as to inhibit the grain growth in a sintering process and to improve magnetic properties and the suitable sintering temperature range.

According to Japanese Patent Laid-Open No. 2002-75717, the suitable sintering temperature range is extended by the dispersion and precipitation of the M-B compound. However, in Example 3-1 described in the above publication, the suitable sintering temperature range is narrow, such as approximately 20° C. Accordingly, to obtain high magnetic properties using a mass-production furnace or the like, it is desired to further extend the suitable sintering temperature range. Moreover, in order to obtain a sufficiently wide suitable sintering temperature range, it is effective to increase the additive amount of Zr. However, as the additive amount of Zr increases, the residual magnetic flux density decreases, and thus, high magnetic properties of interest cannot be obtained.

SUMMARY OF THE INVENTION

Hence, it is an object of the present invention to provide an R-T-B system rare earth permanent magnet, which enables to inhibit the grain growth, while keeping a decrease in magnetic properties to a minimum, and also enables to further improve the suitable sintering temperature range.

The present inventors have found that when a specific product exists in the triple-point grain boundary phase or two-grain grain boundary phase of an R-T-B system rare earth permanent magnet with a certain composition containing Zr, the growth of an $R_2T_{14}B$ phase (which exists as crystal grains) is inhibited during a sintering process so that the suitable sintering temperature range can be extended to an appropriate range.

The present invention is made based on the above findings, and it provides an R-T-B system rare earth permanent magnet, which is a sintered body comprising a main phase consisting of an $R_2T_{14}B$ phase (wherein R represents one or more rare earth elements (providing that the rare earth elements include Y), and T represents one or more transition metal elements essentially containing Fe, or Fe and Co), and a grain boundary phase containing a higher amount of R than the above main phase, wherein a platy or acicular product exists.

In the R-T-B system rare earth permanent magnet of the present invention, it is important that the above product exists in the grain boundary phase and further that it exists along the above $R_2T_{14}B$ phase.

In the R-T-B system rare earth permanent magnet of the present invention, the ratio of the longest diameter (major axis) and the diameter (minor axis) obtained by cutting with a line orthogonal to the longest diameter, that is, the mean value of the axis ratio (=major axis/minor axis)of the product is preferably 5 or greater. Moreover, it is preferable that the major axis of the product is within the range between 30 and 600 nm and the minor axis thereof is within the range between 3 and 50 nm.

In the R-T-B system rare earth permanent magnet of the present invention, the above sintered body preferably contains Zr, and the above product is preferably rich in Zr. This product has periodic composition fluctuations of Zr and R in the minor axis direction.

Effects obtained by the extension of the suitable sintering temperature range by allowing the platy or acicular product to exist in the grain boundary phase become significant, when the amount of oxygen contained in the above sintered body is 2,000 ppm or less.

In the R-T-B system rare earth permanent magnet of the present invention, the sintered body preferably has a composition consisting essentially of 28% to 33% by weight of R, 0.5% to 1.5% by weight of B, 0.03% to 0.3% by weight of Al, 0.3% or less by weight (excluding 0) of Cu, 0.05% to 0.2% by weight of Zr, 4% or less by weight (excluding 0) of Co, and the balance substantially being Fe.

In addition, in the R-T-B system rare earth permanent magnet of the present invention, the sintered body preferably contains 0.1% to 0.15% by weight of Zr.

BRIEF DESCRIPTION OF THE DRAWINGS

FIG. 10 is a table showing the chemical compositions of low R alloys and high R alloys used for types A to C in Example 1;

FIG. 15 is a table showing the amount of oxygen and the amount of nitrogen of each of the permanent magnets of types A to C obtained in Example 1, and the size of a product observed in each of the permanent magnets of types A and B;

FIG. 21 is table showing the chemical compositions of low R alloys and high R alloys used for types D to G in Example 2, and the compositions of sintered bodies that are the permanent magnets obtained in Example 1;

FIG. 22 is a table showing the amount of oxygen and the amount of nitrogen of each of the permanent magnets of types D to G obtained in Example 2, and the size of a product observed in each of the permanent magnets of types D to G;

FIG. 23 is a table showing the combinations of low R alloys and high R alloys used in Example 3, and the compositions of the obtained permanent magnets;

FIG. 24 is a table showing the magnet properties of the permanent magnets obtained in Example 3.

DETAILED DESCRIPTION OF THE PREFERRED EMBODIMENTS

The embodiments of the present invention will be described below.

First, the microstructure of the R-T-B system rare earth permanent magnet of the present invention will be described.

<Microstructure>

As is well known, the R-T-B system rare earth permanent magnet of the present invention is comprised of a sintered body at least containing a main phase consisting of an $R_2T_{14}B$ phase (wherein R represents one or more rare earth elements (providing that the rare earth elements include Y), and T represents one or more types of transition metal elements essentially containing Fe, or Fe and Co), and a grain boundary phase containing a higher amount of R than the main phase.

The R-T-B system rare earth permanent magnet of the present invention contains a triple-point grain boundary phase and a two-grain grain boundary phase that are the grain boundary phases of a sintered body. In the triple-point grain boundary phase and the two-grain grain boundary phase, a product having the following features exists.

Figure 1:
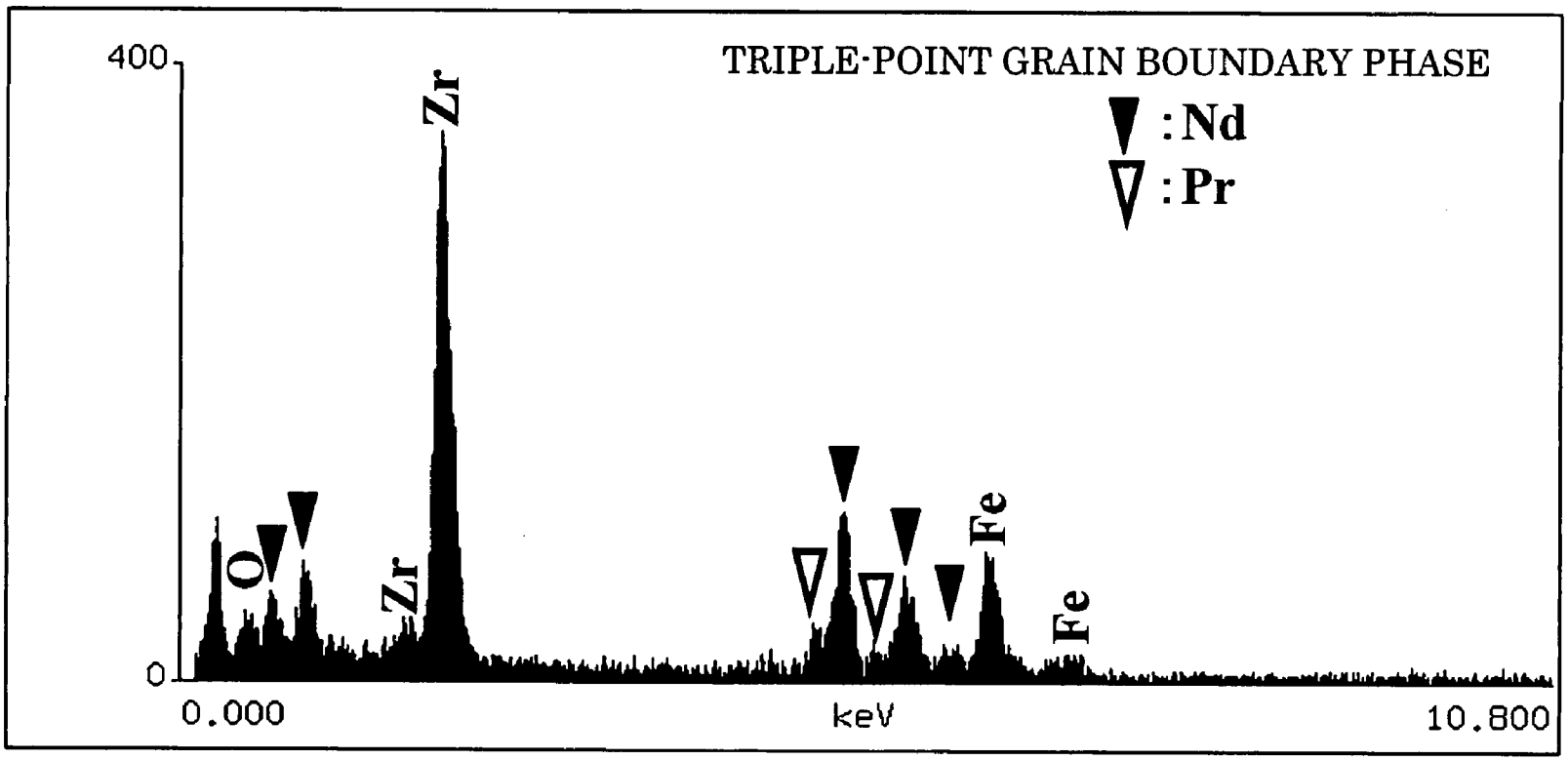
FIG. 1 is a diagram showing an EDS (energy dispersive X-ray analyzer) profile of a product existing in the triple-point grain boundary phase of a permanent magnet (type A) in Example 1.
Figure 2:
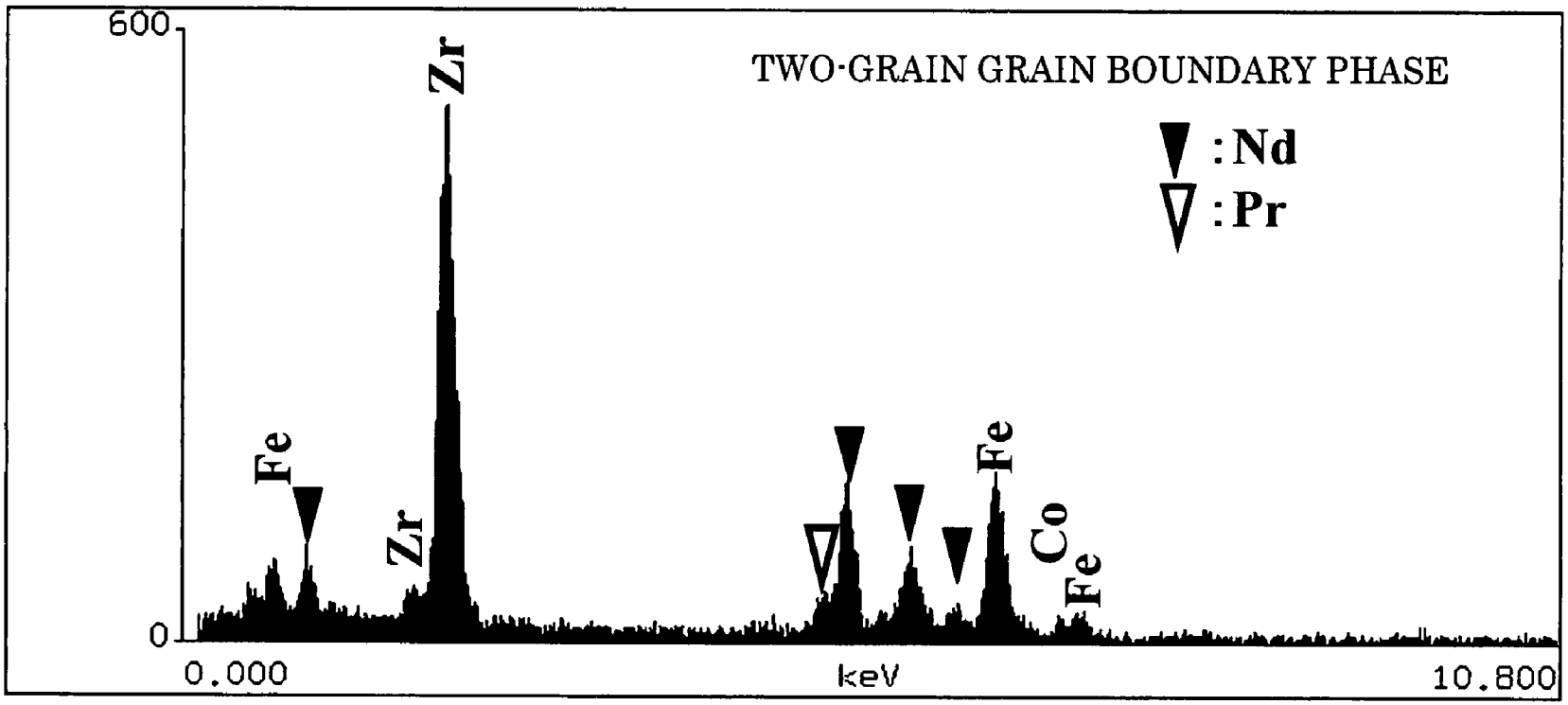
FIG. 2 is a diagram showing an EDS profile of a product existing in the two-grain grain boundary phase of a permanent magnet (type A) in Example 1.

FIGS. 1 and 2 show EDS (energy dispersive X-ray analyzer) profiles of a product existing in the triple-point grain boundary phase and a product existing in the two-grain grain boundary phase of the R-T-B system rare earth permanent magnet of type A in Example 1 described later. FIGS. 3 to 9 as shown below are also based on the observation of the R-T-B system rare earth permanent magnet of type A in Example 1 described later.

As shown in FIGS. 1 and 2, this product is rich in Zr and further contains Nd as R and Fe as T. In a case where the R-T-B system rare earth permanent magnet contains Co or Cu, these elements may be contained in the product.

Figure 3:
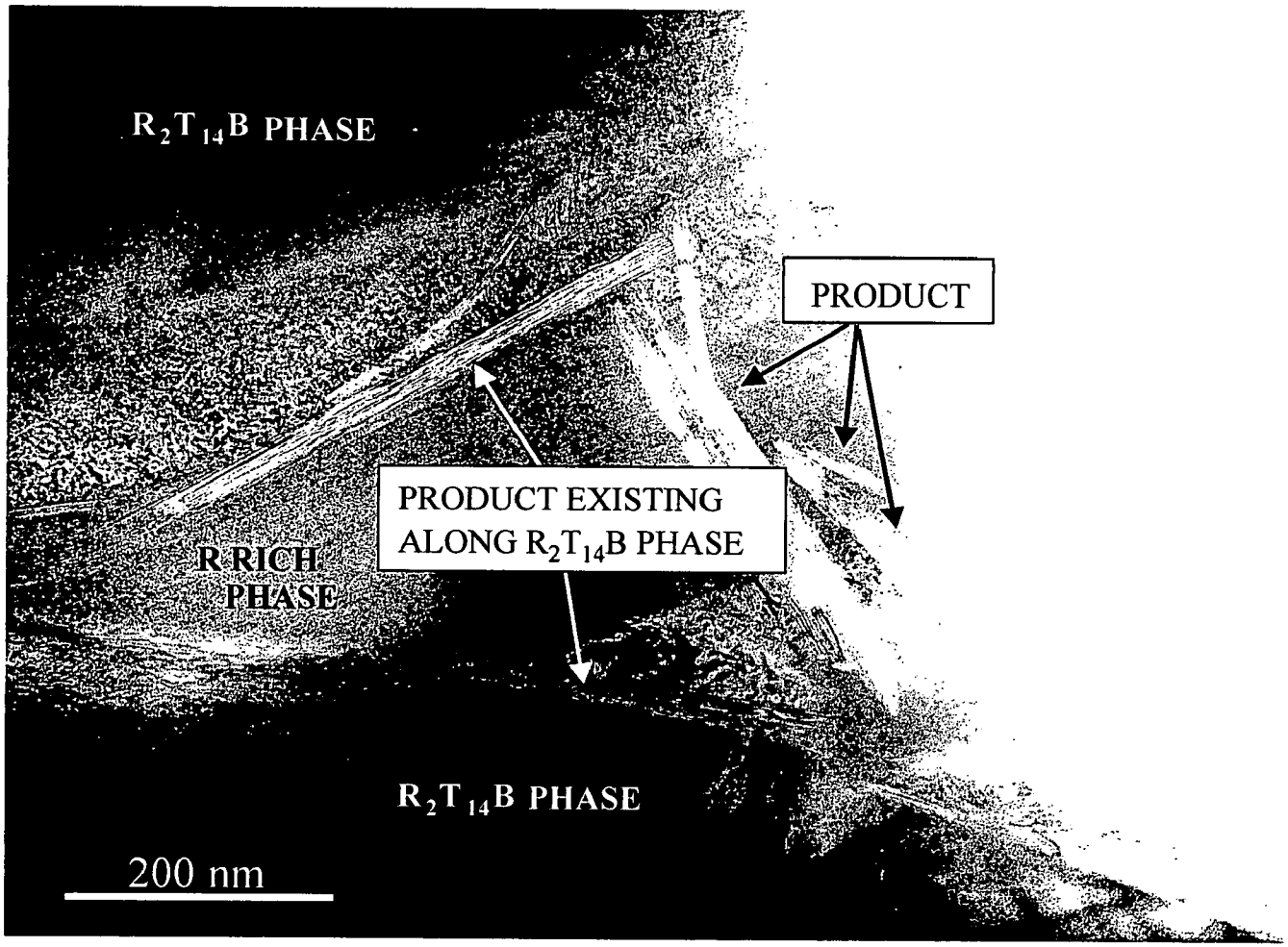
FIG. 3 is a TEM (Transmission Electron Microscope) photograph of the triple-point grain boundary phase and periphery thereof, of a permanent magnet (type A) in Example 1.
Figure 4:
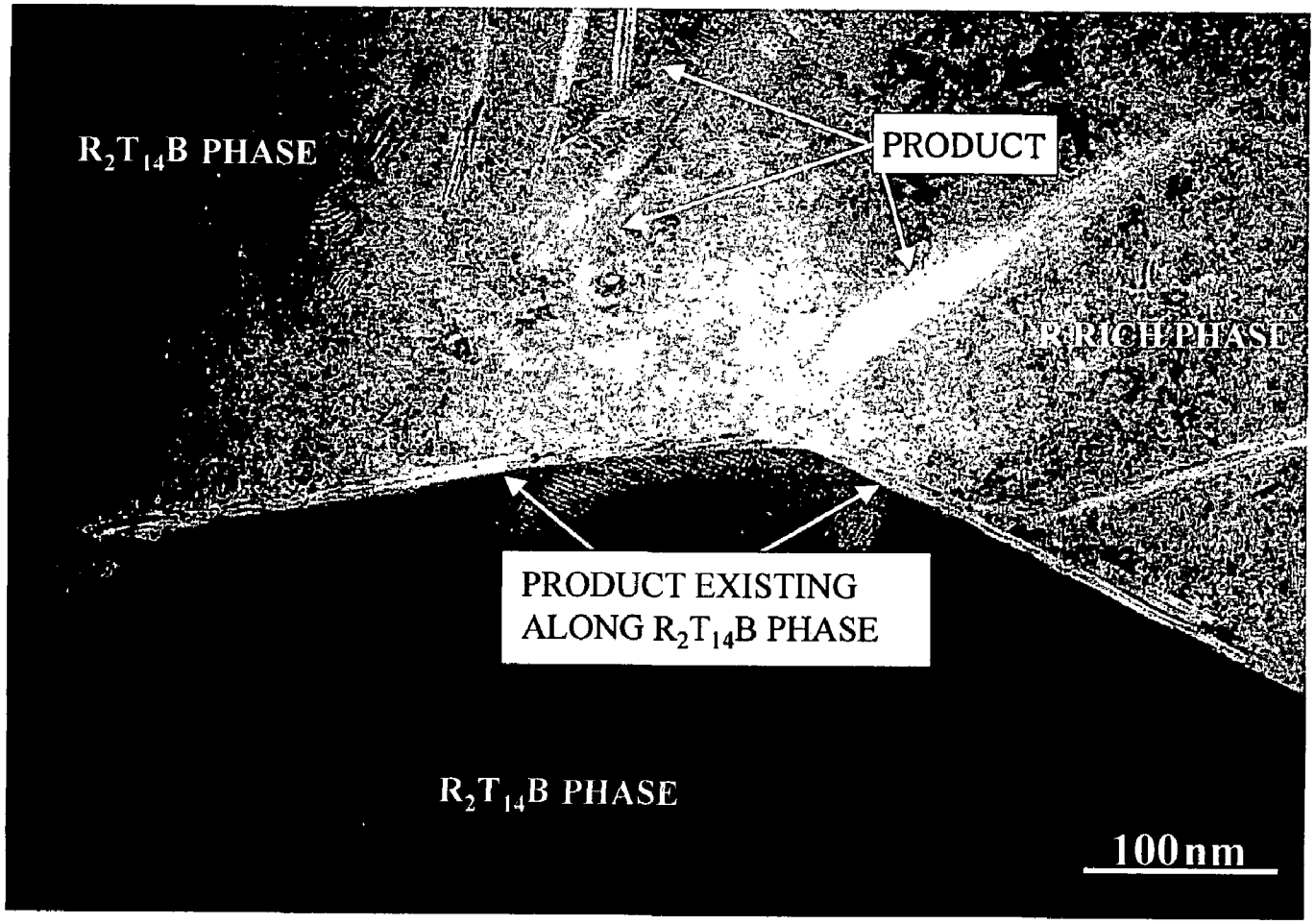
FIG. 4 is another TEMphotograph of the triple-point grain boundary phase and periphery thereof, of a permanent magnet (type A) in Example 1.
Figure 5:
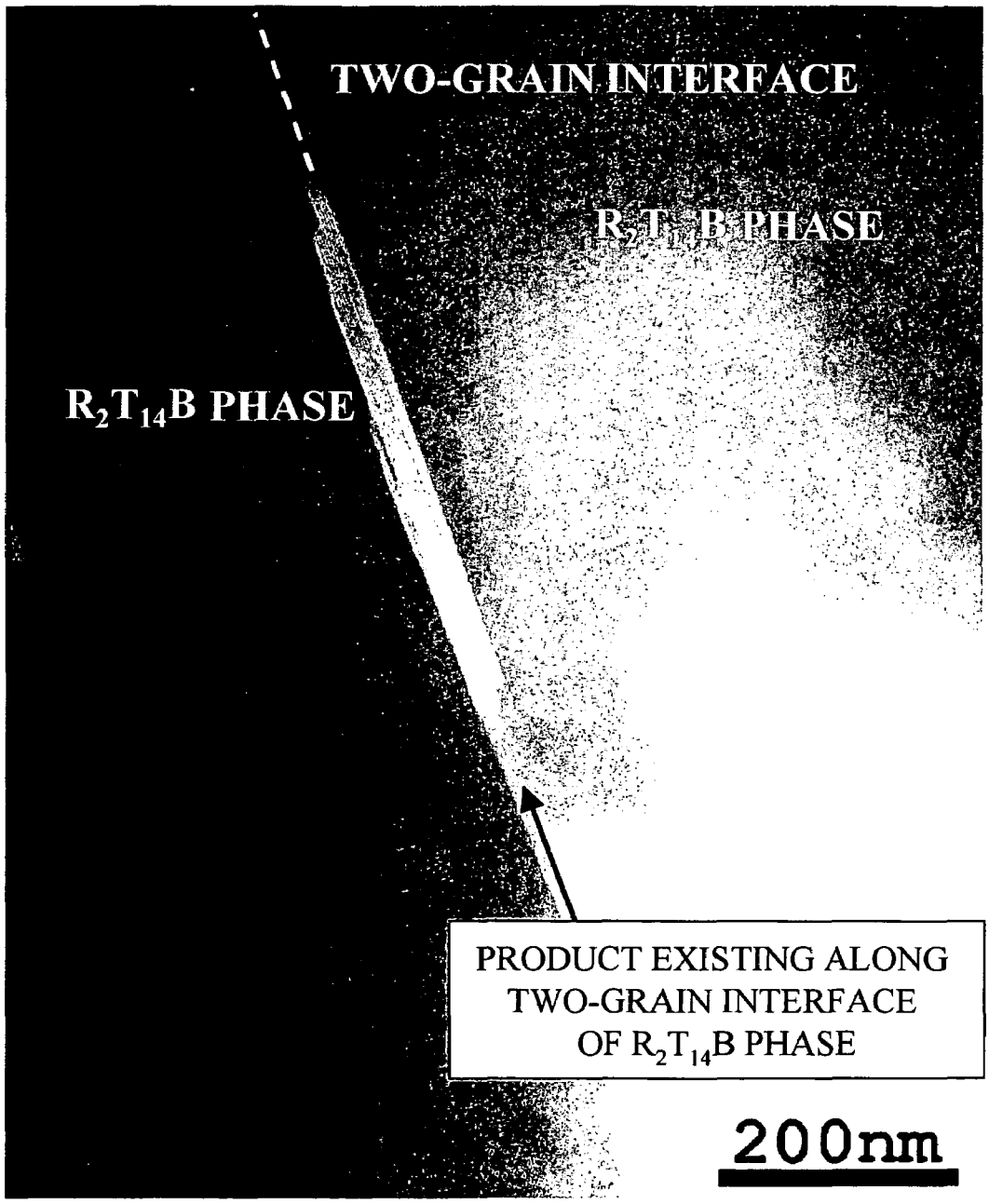
FIG. 5 is a TEM photograph of the two-grain interface and periphery thereof, of a permanent magnet (type A) in Example 1.
Figure 6:
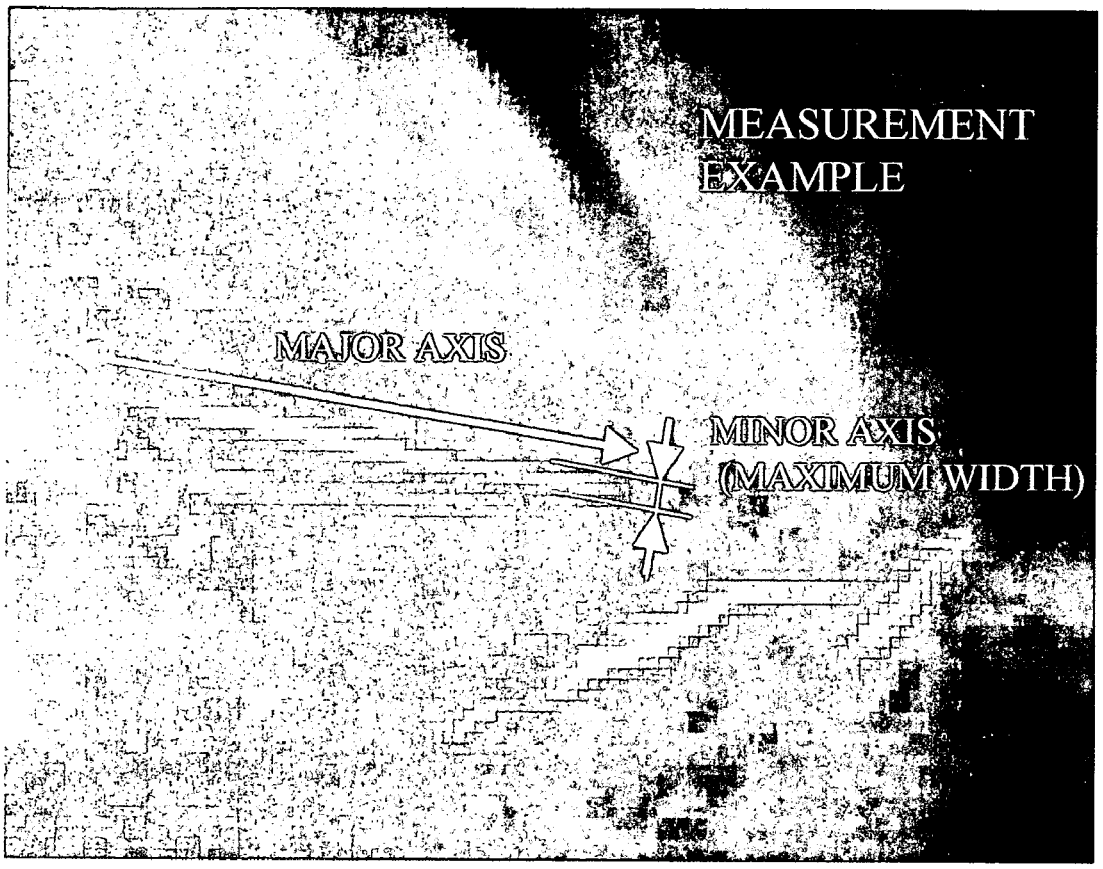
FIG. 6 is a figure showing a method for measuring the major axis and minor axis of a product.

Each of FIGS. 3 and 4 is a TEM (Transmission Electron Microscope) photograph of the triple-point grain boundary phase and periphery thereof, of the permanent magnet of type A in Example 1. FIG. 5 is a TEM photograph of the two-grain interface and periphery thereof, of the permanent magnet of type A. As shown in FIGS. 3 to 5, this product has a platy or acicular form. The determination of the form of the product is based on the observation of a cross section of the sintered body. Accordingly, it is difficult to determine from this observation whether the form is platy or acicular, and therefore, the form is described as being platy or acicular. This platy or acicular product has a major axis of 30 to 600 nm, a minor axis of 3 to 50 nm, and an axis ratio (major axis/minor axis) of 5 to 70. A method for measuring the major axis and minor axis of the product is shown in FIG. 6.

Figure 7:
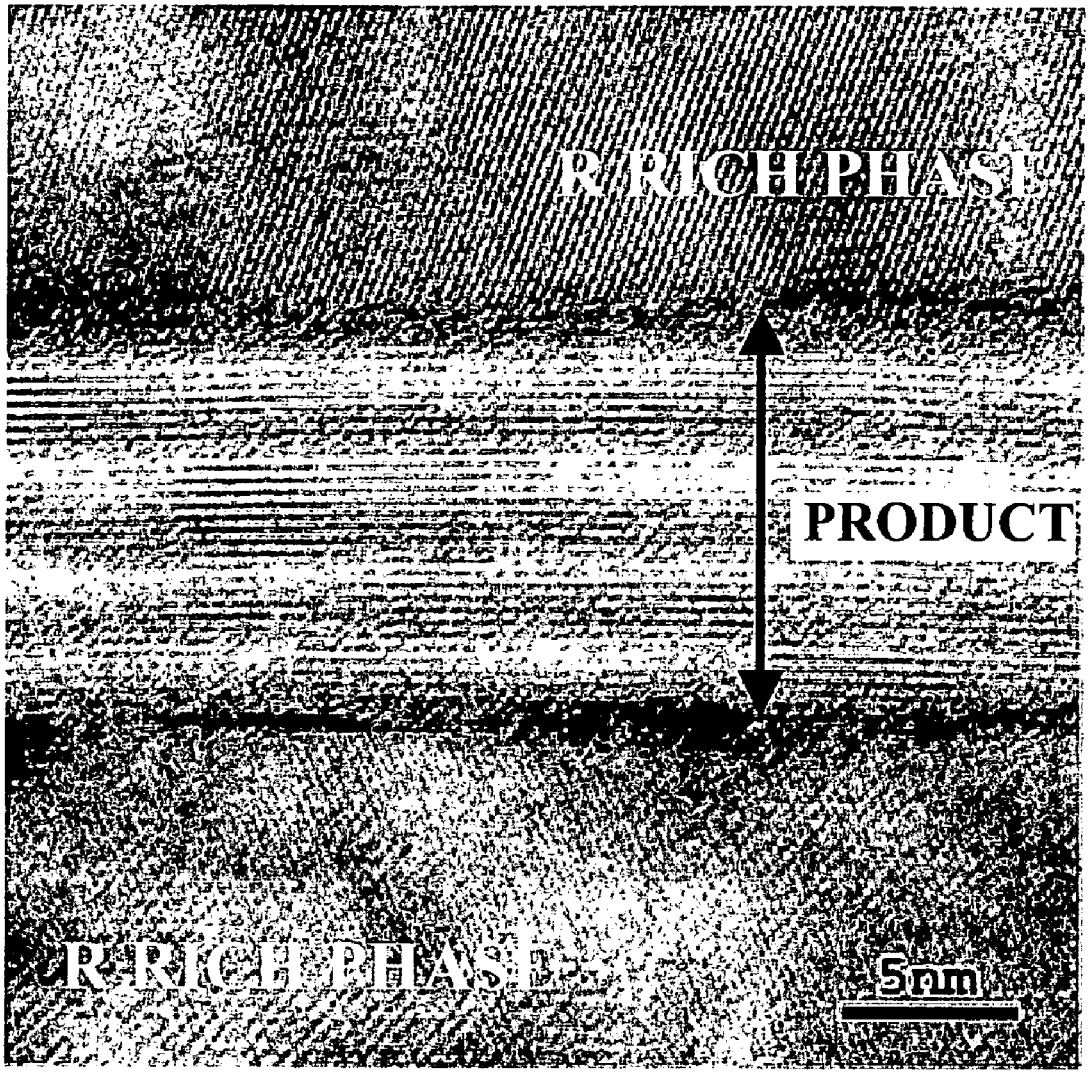
FIG. 7 is a high resolution TEM photograph of the triple-point grain boundary phase and periphery thereof, of a permanent magnet (type A) in Example 1.

FIG. 7 is a high resolution TEM photograph of the triple-point grain boundary phase and periphery thereof, of the R-T-B system rare earth permanent magnet of type A. As explained later, this product has a periodic fluctuation of the composition in the minor axis direction (in the direction of the arrow as shown in FIG. 7).

Figure 8:
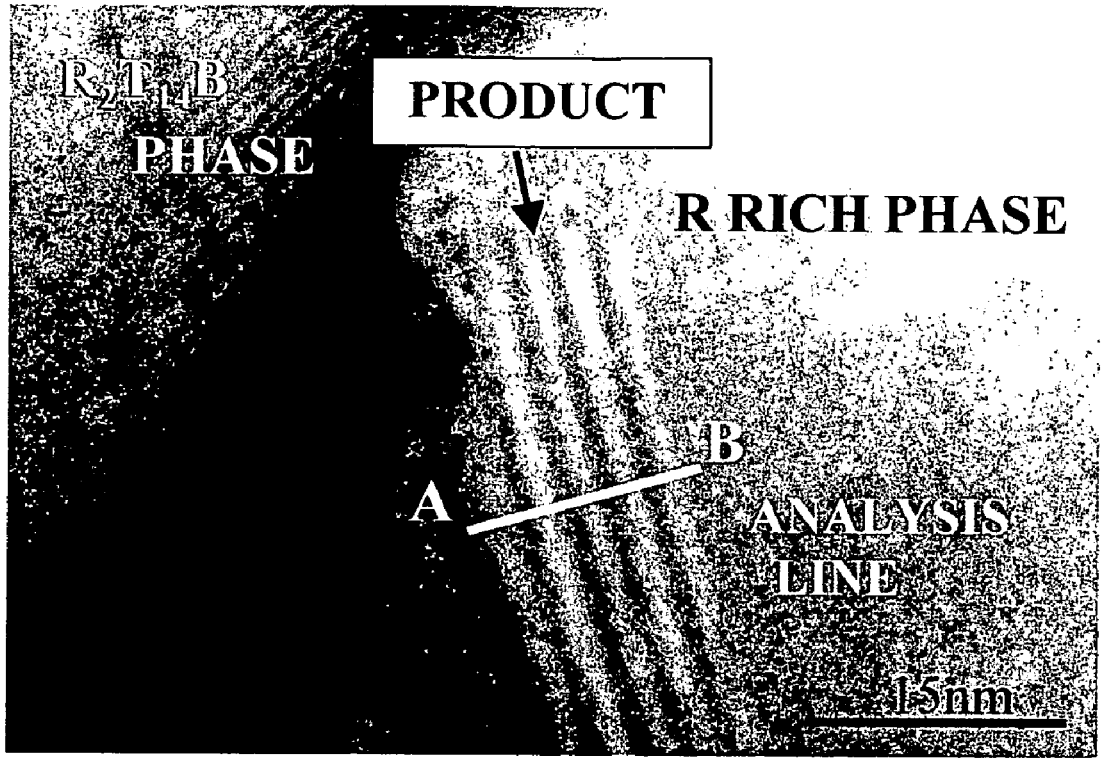
FIG. 8 is an STEM (Scanning Transmission Electron Microscope) photograph of the triple-point grain boundary phase and periphery thereof, of a permanent magnet (type A) in Example 1.
Figure 9:
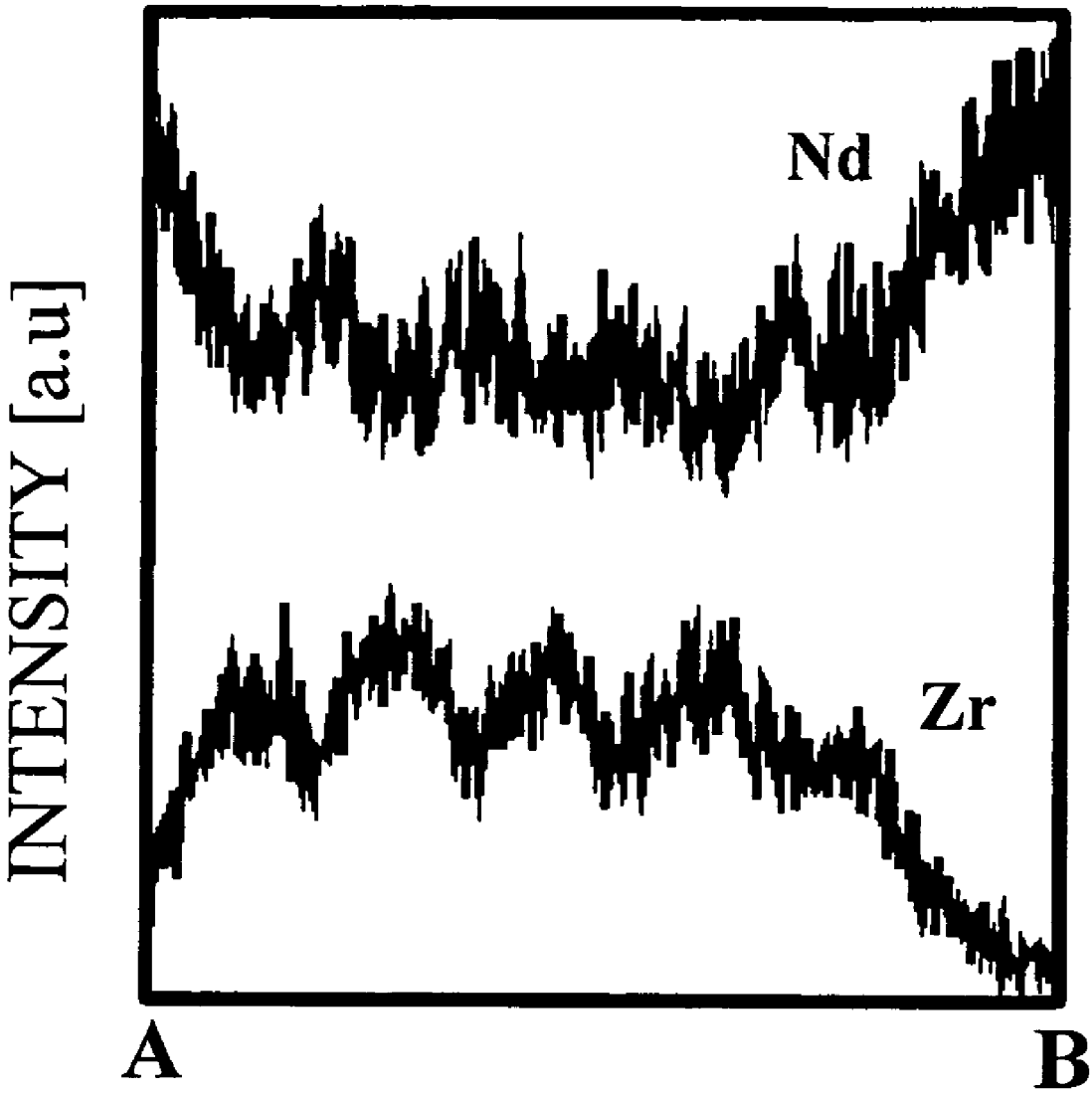
FIG. 9 is a diagram showing the results of a line analysis of the product shown in FIG. 8 by STEM-EDS.

FIG. 8 is a STEM (Scanning Transmission Electron Microscope) photograph of the product. FIG. 9 shows a concentration distribution of Nd and Zr expressed by change in the intensity of the spectrum of Nd—Lα and Zr—Lα lines that is obtained when an EDS line analysis is carried out on an analysis line A-B crossing over the product shown in FIG. 8. As shown in FIG. 9, in this product, the concentration of Nd (R) is low in the region where the concentration of Zr is high. In contrast, the concentration of Nd (R) is high in the region where the concentration of Zr is low. Thus, it can be seen that the product shows a periodic fluctuation of the composition in which Zr and Nd (R) are involved.

With regard to R-T-B system rare earth permanent magnets obtained by two different manufacturing methods, their products were observed. More specifically, these products are types A and B in Example 1 described later. It is noted that the methods for manufacturing an R-T-B system rare earth permanent magnet include a method of using as a starting alloy a single alloy having a desired composition (hereinafter referred to as a single method), and a method of using as starting alloys a plurality of alloys having different compositions (hereinafter referred to as a mixing method). In the mixing method, alloys containing an $R_2T_{14}B$ phase as a main constituent (low R alloys) and alloys containing a higher amount of R than the low R alloys (high R alloys) are typically used as starting alloys. Both of the two manufacturing methods used herein are the mixing methods. The two methods are a method of adding Zr to the low R alloys (type A) and a method of adding Zr to the high R alloys (type B). The chemical compositions of low R alloys and high R alloys used for types A and B are shown in FIG. 10.

Figure 11:
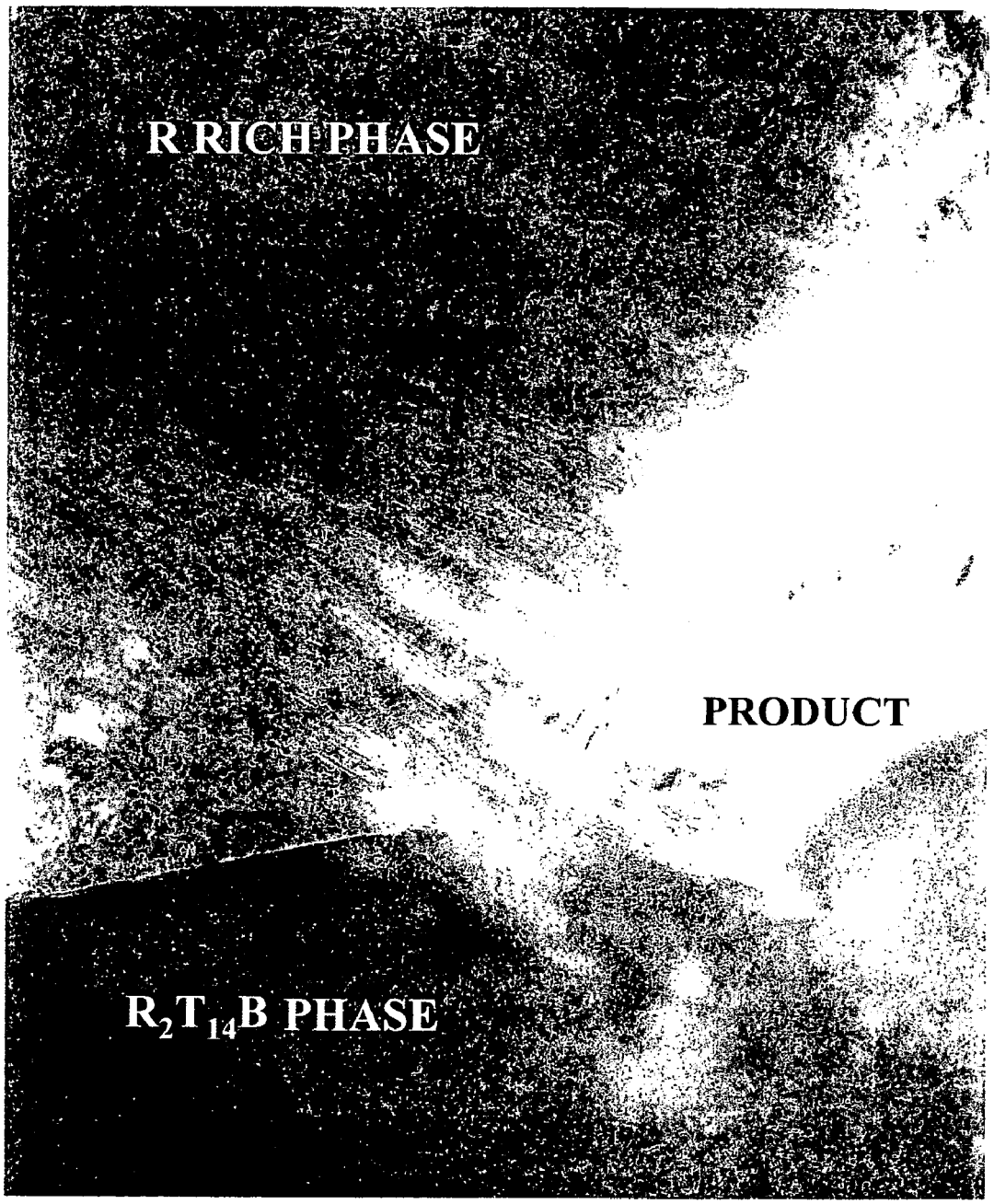
FIG. 11 is a TEM photograph of the permanent magnet (type B) obtained in Example 1.

The analysis results for the above described products are common in samples obtained from the R-T-B system rare earth permanent magnets of types A and B. The results obtained by comparing the product of type A with that of type B are shown below. First, with regard to the compositions of the products, there are no considerable differences between both the products. With regard to the size of the products, both types A and B are almost the same in their minor axis, but the product of type A has a longer major axis than type B in many cases. Accordingly, type A has a larger axis ratio (refer to FIG. 15 shown later). When the existing states of both the products are observed, the product of type A is often present along the surface of the $R_2T_{14}B$ phase as shown in FIGS. 3 and 4, or is often present, penetrating the two-grain interface as shown in FIG. 5. In contrast, the product of type B is often present, digging into the surface of the $R_2T_{14}B$ phase as shown in FIG. 11.

Now, the reason why the above difference is found between types A and B will be considered in the light of the formation process of the products.

Figure 12:
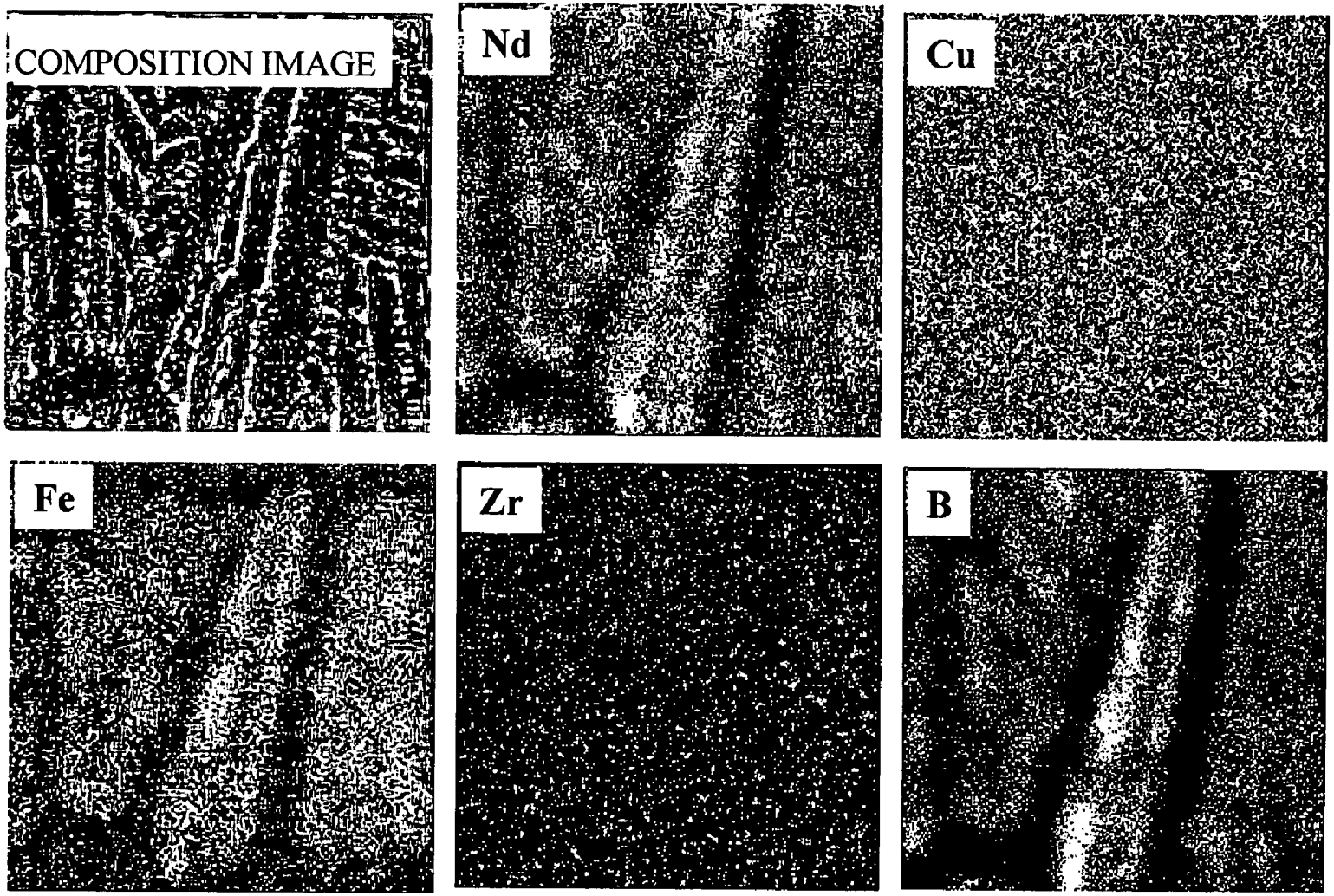
FIG. 12 is a set of photographs showing the EPMA mapping (area analysis) results of a Zr-added low R alloy used for the permanent magnet (type A) in Example 1.
Figure 13:
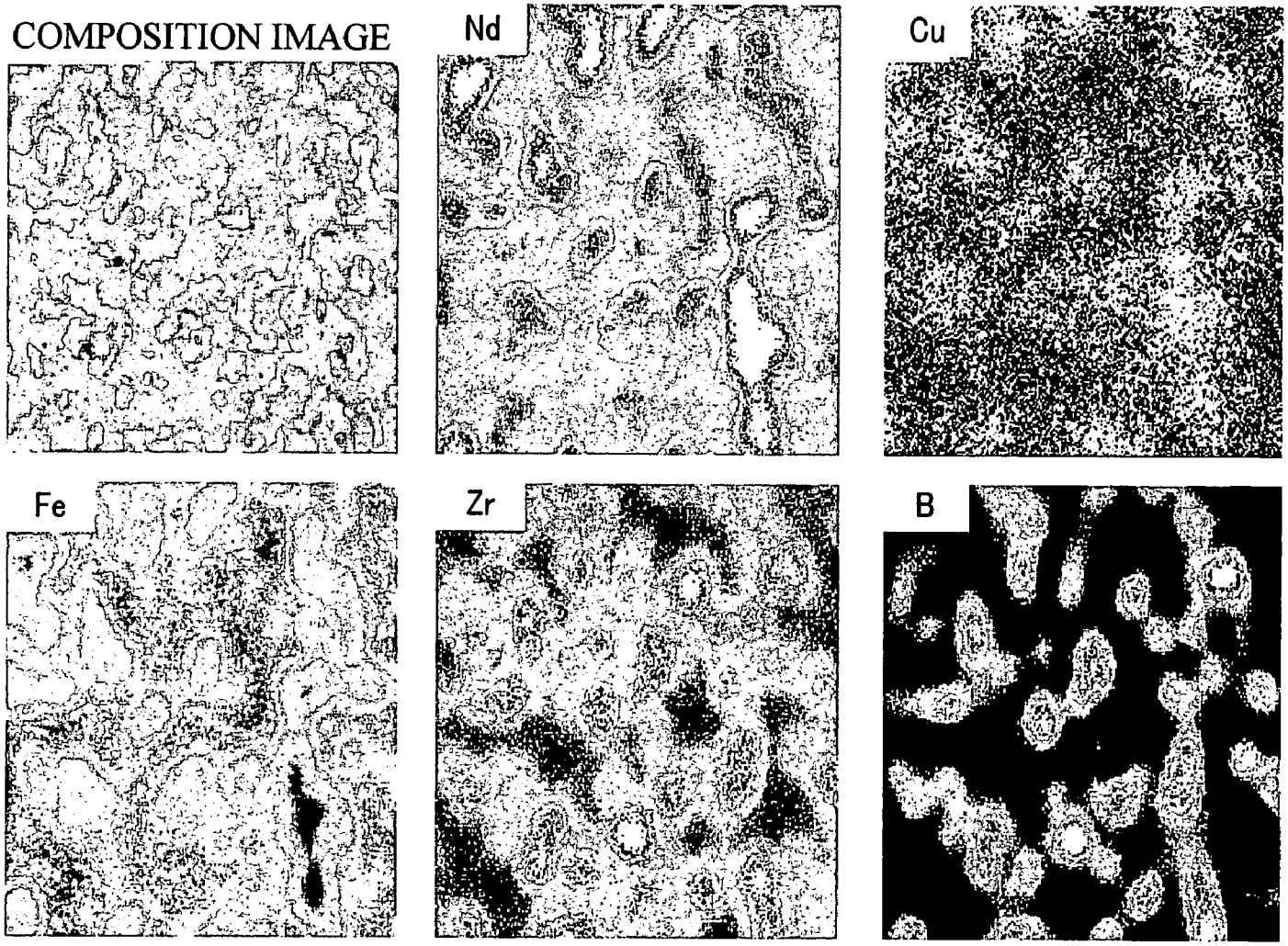
FIG. 13 is a set of photographs showing the EPMA mapping (area analysis) results of a Zr-added high R alloy used for the permanent magnet (type B) in Example 1.

FIG. 12 shows the results of the element mapping (area analysis) on a Zr-added low R alloy used for type A by EPMA (Electron Probe Micro Analyzer). FIG. 13 shows the results of the element mapping (area analysis) on a Zr-added high R alloy used for type B by EPMA (Electron Probe Micro Analyzer). As shown in FIG. 12, the Zr-added low R alloy used for type A comprises at least two phases each having a different amount of Nd. However, in its low Ralloy, Zr is uniformly dispersed, and it is not concentrated in a certain phase.

In contrast, in the Zr-added high R alloy used for type B, as shown in FIG. 13, both Zr and B are present in concentrated amounts, in a portion with a high concentration of Nd.

Hence, Zr existing in type A is considerably uniformly distributed in a mother alloy, it is concentrated in a grain boundary phase (liquid phase) during the sintering process, and a nucleation starts in the liquid phase, then reaching the crystal growth. It then becomes a product, which extends to the easy-crystal grain growth direction because the crystal grows following a nucleation. By this, it is considered that Zr in type A has an extremely large axis ratio. On the other hand, in the case of type B, since a Zr rich phase is formed in the mother alloy stage, the Zr concentration in a liquid phase is hardly increased in the sintering process. Thereafter, since the product is grown based on the existing Zr rich phase as a nucleus, it cannot grow freely. Thus, it is assumed that Zr in type B does not have a large axis ratio.

Accordingly, in order that the present product functions more effectively, the following points would be important:

(1) in the stage of a mother alloy, Zr is present in an $R_2T_{14}B$ phase, R rich phase or the like, in the form of a solid solution, or it is finely deposited in the phases, (2) a product is generated from a liquid phase during the sintering process, and (3) the growth of the product progresses without the prevention of its growth (achievement of a high axis ratio).

As described later in Example 1, the presence of the product enables to extend the suitable sintering temperature range, while inhibiting the decrease of the residual magnetic flux density.

The reason why the presence of the product enables the extension of the suitable sintering temperature range is uncertain at this stage, but the following assumption can be made.

Figure 14:
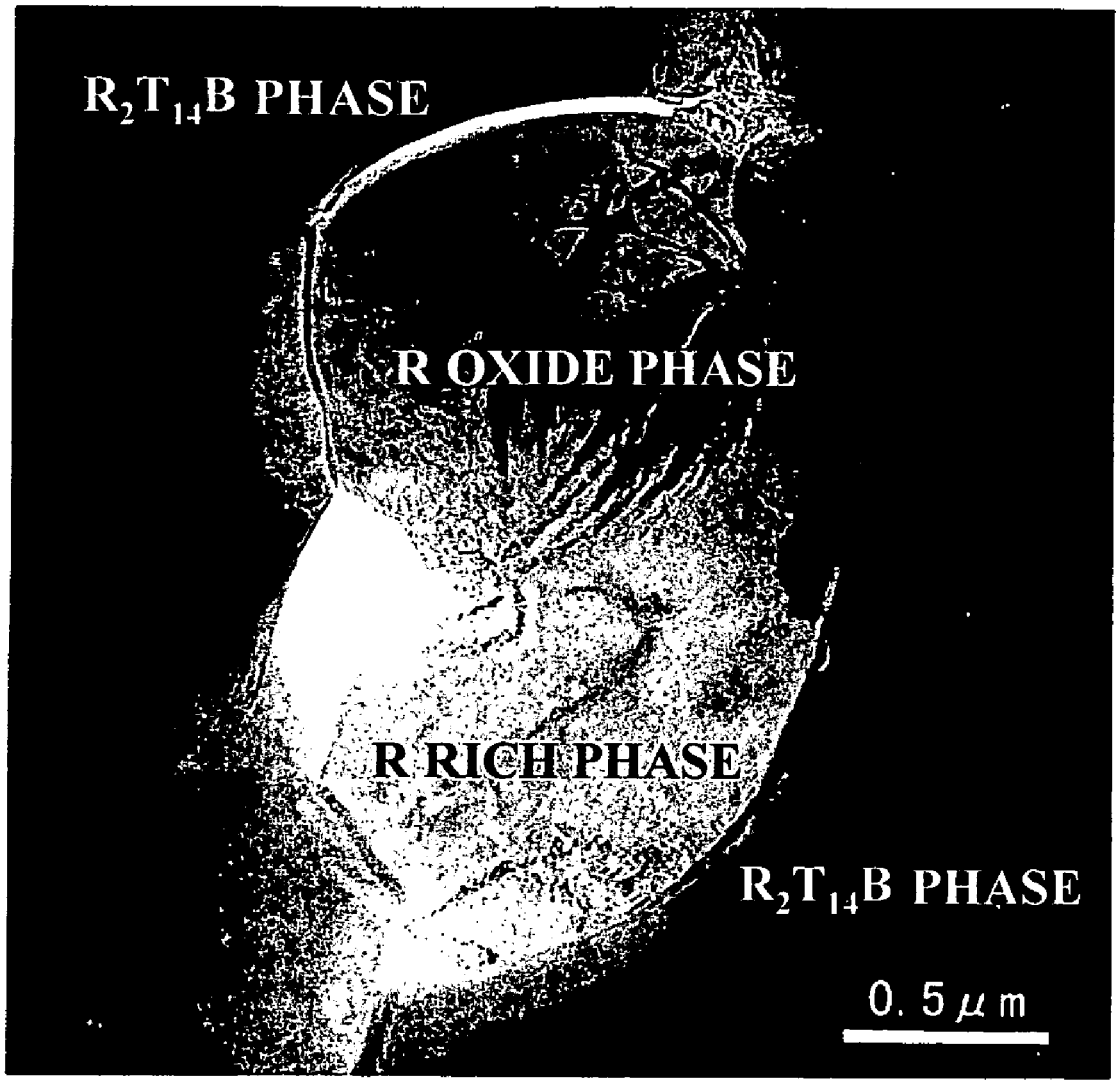
FIG. 14 is a TEM photograph of a rare earth oxide existing in the triple-point grain boundary phase of a permanent magnet.

In an R-T-B system rare earth permanent magnet containing oxygen of 3,000 ppm or more, the grain growth is inhibited by the presence of a rare earth oxide phase. The form of the rare earth oxide phase is almost spherical, as shown in FIG. 14. Even when the amount of oxygen is reduced without adding Zr, if the remaining amount of oxygen is approximately 1,500 to 2,000 ppm, high magnetic properties can still be obtained. In this case, however, the suitable sintering temperature range is extremely narrow. When the amount of oxygen is further reduced to 1,500 ppm or lower, grain growth significantly occurs during the sintering process, and accordingly, it becomes difficult to obtain high magnetic properties. It is possible to decrease the sintering temperature and to carry out sintering for a long time, so as to obtain high magnetic properties. However, this is not industrially practical.

Contrary to the above methods, the behavior in a Zr addition system will be considered. Even when Zr is added to a common R-T-B system rare earth permanent magnet, its effect to inhibit the grain growth is not observed. As the additive amount is increased, the residual magnetic flux density is decreased. However, when the amount of oxygen is reduced from an R-T-B system rare earth permanent magnet to which Zr is added, high magnetic properties can be obtained in a wide suitable sintering temperature range. Accordingly, compared with the amount of oxygen, the addition of a small amount of Zr inhibits the grain growth more sufficiently.

From these facts, it can be said that the effect of adding Zr appears, when the amount of oxygen is reduced and thereby the amount of the formed rare earth oxide phase is significantly reduced. That is to say, it is considered that Zr forms a product which plays the role of the rare earth oxide phase.

Moreover, as described later in Example 1, the present product has an anisotropic form. The ratio between its longest diameter (major axis) and the diameter (minor axis) obtained by cutting with a line orthogonal to the longest diameter, that is, an axis ratio (=major axis/minor axis) is extremely large. Thus, the form of the present product significantly differs from the isotropic form of a rare earth oxide (e.g., a spherical, in this case, the axis ratio is almost 1). Accordingly, the present product has a high probability to contact with an $R_2T_{14}B$ phase, and further, the surface area of the product is larger than that of a spherical rare earth oxide. It is therefore considered that the present product inhibits the movement of grains through the grain boundary that is necessary for the grain growth, and that the suitable sintering temperature range is thereby extended only by the addition of a small amount of Zr.

From the above point of view, it is considered that since the product of type A has a large axis ratio, it more effectively has the above effect only by the addition of a small amount of Zr.

As described above, a product that is rich in Zr and has a large axis ratio is allowed to exist in the triple-point grain boundary phase or two-grain grain boundary phase of an R-T-B system rare earth permanent magnet containing Zr, so that the growth of the $R_2T_{14}B$ phase is inhibited during the sintering process, thereby the suitable sintering temperature range is improved. Therefore, according to the present invention, a heat treatment on a large permanent magnet and a stable manufacturing of an R-T-B system rare earth permanent magnet using such a large heat treatment furnace can be easily carried out.

Moreover, by increasing the axis ratio of the product, although only a small amount of Zr is added, it exerts its effect sufficiently. Accordingly, an R-T-B system rare earth permanent magnet with high magnetic properties can be manufactured without causing the decrease of the residual magnetic flux density. This effect can be sufficiently exerted, when the concentration of oxygen in alloys or during the manufacturing process is reduced.

<Chemical Composition>

Next, a desired composition of the R-T-B system rare earth permanent magnet of the present invention will be explained. The term chemical composition is used herein to mean a chemical composition obtained after sintering.

The rare earth permanent magnet of the present invention contains 25% to 35% by weight of R.

The term R is used herein to mean one or more rare earth elements selected from a group consisting of La, Ce, Pr, Nd, Sm, Eu, Gd, Tb, Dy, Ho, Er, Yb, Lu and Y. If the amount of R is less than 25% by weight, an $R_2T_{14}B$, phase as a main phase of the rare earth permanent magnet is not sufficiently generated. Accordingly, α-Fe or the like having soft magnetism is deposited and the coercive force significantly decreases. On the other hand, if the amount of R exceeds 35% by weight, the volume ratio of the $R_2T_{14}B$ phase as a main phase decreases, and the residual magnetic flux density decreases. Moreover, if the amount of R exceeds 35% by weight, R reacts with oxygen, and the content of oxygen thereby increases. In accordance with the increase of the oxygen content, an R rich phase effective for the generation of coercive force decreases, resulting in a reduction in the coercive force. Therefore, the amount of R is set between 25% and 35% by weight. The amount of R is preferably between 28% and 33% by weight, and more preferably between 29% and 32% by weight.

Since Nd is abundant as a source and relatively inexpensive, it is preferable to use Nd as a main component of rare earth elements. Moreover, since the containment of Dy increases an anisotropic magnetic field, it is effective to contain Dy to improve the coercive force. Accordingly, it is desired to select Nd and Dy for R and to set the total amount of Nd and Dy between 25% and 33% by weight. In addition, in the above range, the amount of Dy is preferably between 0.1% and 8% by weight. It is desired that the amount of Dy is arbitrarily determined within the above range, depending on which is more important, a residual magnetic flux density or a coercive force. This is to say, when a high residual magnetic flux density is required to be obtained, the amount of Dy is preferably set between 0.1% and 3.5% by weight. When a high coercive force is required to be obtained, it is preferably set between 3.5% and 8% by weight.

Moreover, the rare earth permanent magnet of the present invention contains 0.5% to 4.5% by weight of boron (B). If the amount of B is less than 0.5% by weight, a high coercive force cannot be obtained. However, if the amount of B exceeds 4.5% by weight, the residual magnetic flux density is likely to decrease. Accordingly, the upper limit is set at 4.5% by weight. The amount of B is preferably between 0.5% and 1.5% by weight, and more preferably between 0.8% and 1.2% by weight.

The R-T-B system rare earth permanent magnet of the present invention may contain Al and/or Cu within the range between 0.02% and 0.6% by weight. The containment of Al and/or Cu within the above range can impart a high coercive force, a strong corrosion resistance, and an improved temperature stability of magnetic properties to the obtained permanent magnet. When Al is added, the additive amount of Al is preferably between 0.03% and 0.3% by weight, and more preferably between 0.05% and 0.25% by weight. When Cu is added, the additive amount of Cu is 0.3% or less by weight (excluding 0), preferably 0.15% or less by weight (excluding 0), and more preferably between 0.03% and 0.08% by weight.

The R-T-B system rare earth permanent magnet of the present invention preferably contains Zr within the range between 0.03% and 0.25% by weight, so as to generate the above described product that is rich in Zr. When the content of oxygen is reduced to improve the magnetic properties of the R-T-B system rare earth permanent magnet, Zr exerts the effect of inhibiting the abnormal grain growth in a sintering process and thereby makes the microstructure of the sintered body uniform and fine. Accordingly, when the amount of oxygen is low, Zr fully exerts its effect. The amount of Zr is preferably between 0.05% and 0.2% by weight, and more preferably between 0.1% and 0.15% by weight.

The R-T-B system rare earth permanent magnet of the present invention contains 2,000 ppm or less oxygen. If it contains a large amount of oxygen, an oxide phase that is a non-magnetic component increases, thereby decreasing magnetic properties. Thus, in the present invention, the amount of oxygen contained in a sintered body is set at 2,000 ppm or less, preferably 1,500 ppm or less, and more preferably 1,000 ppm or less. However, when the amount of oxygen is simply decreased, an oxide phase having a grain growth inhibiting effect decreases, so that the grain growth easily occurs in a process of obtaining full density increase during sintering. Thus, in the present invention, the R-T-B system rare earth permanent magnet to contains a certain amount of Zr, which exerts the effect of inhibiting the abnormal grain growth in a sintering process.

The R-T-B system rare earth permanent magnet of the present invention contains Co in an amount of 4% or less by weight (excluding 0), preferably between 0.1% and 2.0% by weight, and more preferably between 0.3% and 1.0% by weight. Co forms a phase similar to that of Fe. Co has an effect to improve Curie temperature and the corrosion resistance of a grain boundary phase.

<Manufacturing Method>

Next, preferred embodiments of the method for manufacturing an R-T-B system rare earth permanent magnet of the present invention will be explained.

In the present embodiments, there is described a method for manufacturing the R-T-B system rare earth permanent magnet of the present invention by using alloys (low R alloys) containing an $R_2T_{14}B$ phase as a main constituent and other alloys (high R alloys) containing a higher amount of R than the low R alloys.

Raw material is first subjected to strip casting in a vacuum or an inert gas atmosphere, or preferably an Ar atmosphere, so that low Ralloys and high Ralloys are obtained.

The low R alloys can contain Cu and Al, as well as R, Fe, Co and B. Moreover, the high R alloys can also contain Cu and Al, as well as R, Fe, Co and B.

Zr may be contained either in the low R alloys or in the high R alloys. However, as stated above, Zr is preferably contained in the low R alloys in order that the product has a large axis ratio.

After preparing the low R alloys and the high R alloys, these master alloys are crushed separately or together. The crushing step comprises a crushing process and a pulverizing process. First, each of the master alloys is crushed to a particle size of approximately several hundreds of μm. The crushing is preferably carried out in an inert gas atmosphere, using a stamp mill, a jaw crusher, a brown mill, etc. In order to improve rough crushability, it is effective to carry out crushing after the absorption of hydrogen. Otherwise, it is also possible to release hydrogen after absorbing it and then carry out crushing.

After carrying out the crushing, the routine proceeds to a pulverizing process. In the pulverizing process, a jet mill is mainly used, and crushed powders with a particle size of approximately several hundreds of μm are pulverized to a mean particle size between 3 and 5 μm. The jet mill is a method comprising releasing a high-pressure inert gas (e.g., nitrogen gas) from a narrow nozzle so as to generate a high-speed gas flow, accelerating the crushed powders with the high-speed gas flow, and making crushed powders hit against each other, the target, or the wall of the container, so as to pulverize the powders.

When the low R alloys and the high R alloys are pulverized separately in the pulverizing process, the pulverized low R alloy powders are mixed with the pulverized high R alloy powders in a nitrogen atmosphere. The mixing ratio of the low R alloy powders and the high R alloy powders may be approximately between 80:20 and 97:3 at a weight ratio. Likely, in a case where the low R alloys are pulverized together with the high R alloys, the mixing ratio may be approximately between 80:20 and 97:3 at a weight ratio. When approximately 0.01% to 0.3% by weight of additive agents such as zinc stearate is added during the pulverizing process, fine powders which are well oriented, can be obtained during compacting.

Subsequently, mixed powders comprising of the low R alloy powders and the high R alloy powders are filled in a tooling equipped with electromagnets, and they are compacted in a magnet field, in a state where their crystallographic axis is oriented by applying a magnetic field. This compacting may be carried out by applying a pressure of approximately 0.7 to 1.5 t/cm$^2$ in a magnetic field of 12.0 to 17.0 kOe.

After the mixed powders are compacted in the magnetic field, the compacted body is sintered in a vacuum or an inert gas atmosphere. The sintering temperature needs to be adjusted depending on various conditions such as a composition, a crushing method, the difference between particle size and particle size distribution, but the sintering may be carried out at 1,000° C. to 1,100° C. for about 1 to 5 hours.

After completion of the sintering, the obtained sintered body may be subjected to an aging treatment. The aging treatment is important for the control of a coercive force. When the aging treatment is carried out in two steps, it is effective to retain the sintered body for a certain time at around 800° C. and around 600° C. When a heat treatment is carried out at around 800° C. after completion of the sintering, the coercive force increases. Accordingly, it is particularly effective in the mixing method. Moreover, when a heat treatment is carried out at around 600° C., the coercive force significantly increases. Accordingly, when the aging treatment is carried out in a single step, it is appropriate to carry out it at around 600° C.

EXAMPLES

The present invention will be further described in detail in the following Examples.

Example 1

(1) Mother Alloys

Mother alloys(low R alloys and high R alloys) having compositions shown in FIG. 10 were prepared by the strip casting method. It is noted that Zr was contained in the low R alloys in type A, and that Zr was contained in the high R alloys in type B containing no B. Type C that contained no Zr was a comparative example in the present invention.

(2) Hydrogen Crushing Process

A hydrogen crushing treatment was carried out, in which after hydrogen was absorbed into the mother alloys at room temperature, dehydrogenation was carried out thereon at 600° C. for 1 hour in an Ar atmosphere.

To control the amount of oxygen contained in a sintered body to 2,000 ppm or less, so as to obtain high magnetic properties, in the present experiments, the atmosphere was controlled at an oxygen concentration less than 100 ppm throughout processes, from a hydrogen treatment (recovery after a crushing process) to sintering (input into a sintering furnace).

(3) Mixing and Crushing Processes

Generally, two-step crushing is carried out, which includes crushing process and pulverizing process. However, the crushing process was omitted in the present Examples.

Before carrying out the pulverizing process, 0.05% zinc stearate was added as an additive agent contributing to the improvement of crushability and the improvement of orientation during compacting. Thereafter, using a Nauta Mixer, the low R alloys were mixed with the high R alloys for 30 minutes in the combinations of types A, B and C shown in FIG. 10. In all the types A to C, the mixing ratio between the low R alloys and the high R alloys was 90:10.

Thereafter, the mixture was subjected to the pulverizing with a jet mill to a mean particle size of 5.0 μm.

(4) Compacting Process

The obtained fine powders were compacted in a magnetic field of 14.0 kOe by applying a pressure of 1.2 t/cm$^2$, so as to obtain a compacted body.

(5) Sintering and Aging Processes

The obtained compacted body was sintered at 1,010° C. to 1,090° C. for 4 hours in a vacuum atmosphere, followed by quenching. Thereafter, the obtained sintered body was subjected to a two-step aging treatment consisting of treatments of 800° C.×1 hour and 550° C.×2.5 hours (both in an Ar atmosphere).

The chemical compositions of the obtained permanent magnets are shown in the column "Composition of sintered body" in FIG. 10. The amount of oxygen and the amount of nitrogen of each permanent magnet are shown in FIG. 15. As shown in the figure, the amount of oxygen is 1,000 ppm or less and that of nitrogen is 500 ppm or less, and thus, both the values are low.

The magnetic properties of the obtained permanent magnets were measured with a B-H tracer. The results are shown in FIGS. 15 to 18. In FIGS. 15 to 18, Br represents a residual magnetic flux density and HcJ represents a coercive force. Moreover, a squareness (Hk/HcJ) is an index of magnet performance, and it represents an angular degree in the second quadrant of a magnetic hysteresis loop. Furthermore, Hk means an external magnetic field strength obtained when the magnetic flux density becomes 90% of the residual magnetic flux density in the second quadrant of a magnetic hysteresis loop.

Figure 16:
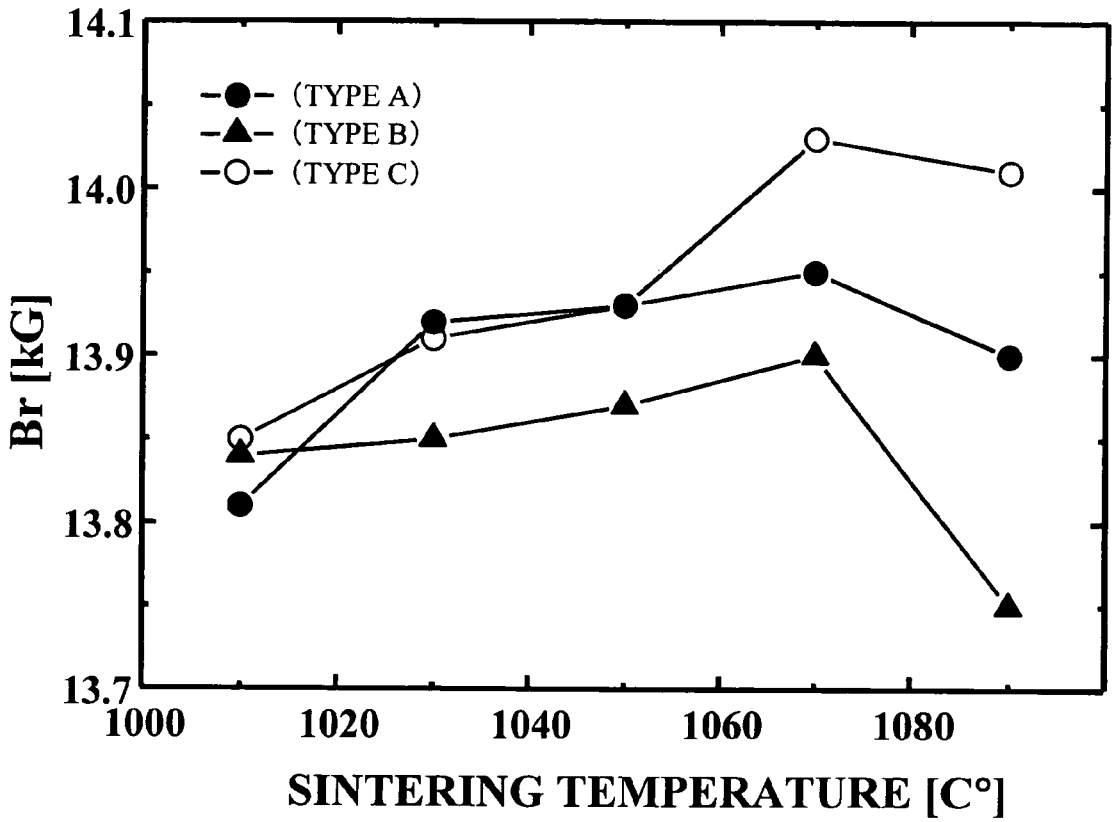
FIG. 16 is a graph showing the relationship between the sintering temperature and the residual magnetic flux density (Br) of the permanent magnets obtained in Example 1.

In reference to FIGS. 15 and 16, when types A, B and C are compared in terms of the residual magnetic flux density (Br), type C that contains no Zr has the highest value at each of the sintering temperatures. Type A has almost the same value as type C. Type A can control a decrease in the residual magnetic flux density (Br) to a minimum by the addition of Zr and can obtain a value of 13.9 kG or greater within the sintering temperature range between 1,030° C. and 1,070° C.

Figure 17:
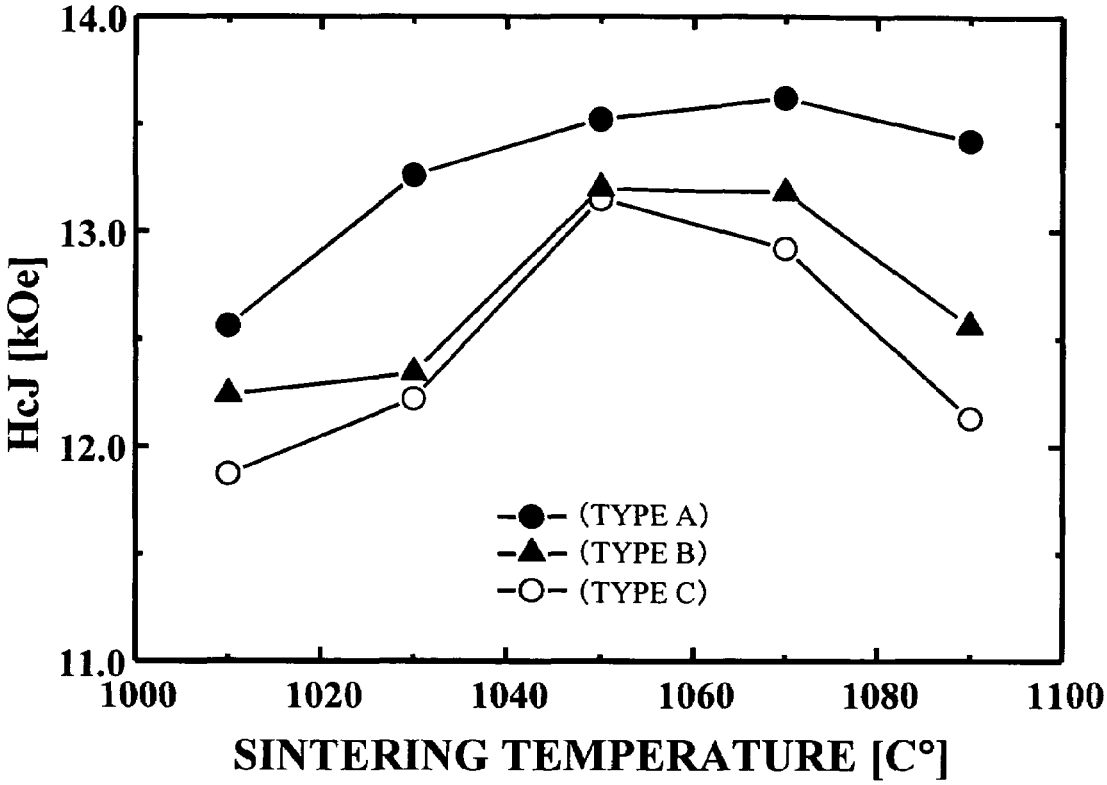
FIG. 17 is a graph showing the relationship between the sintering temperature and the coercive force (HcJ) of the permanent magnets obtained in Example 1.

In reference to FIGS. 15 and 17, when types A, B and C are compared in terms of the coercive force (HcJ), type A has a higher value than types B and C at each of the sintering temperatures. Specifically, a value of 13.0 kOe or greater can be obtained by type A within the sintering temperature range between 1,030° C. and 1,070° C.

Figure 18:
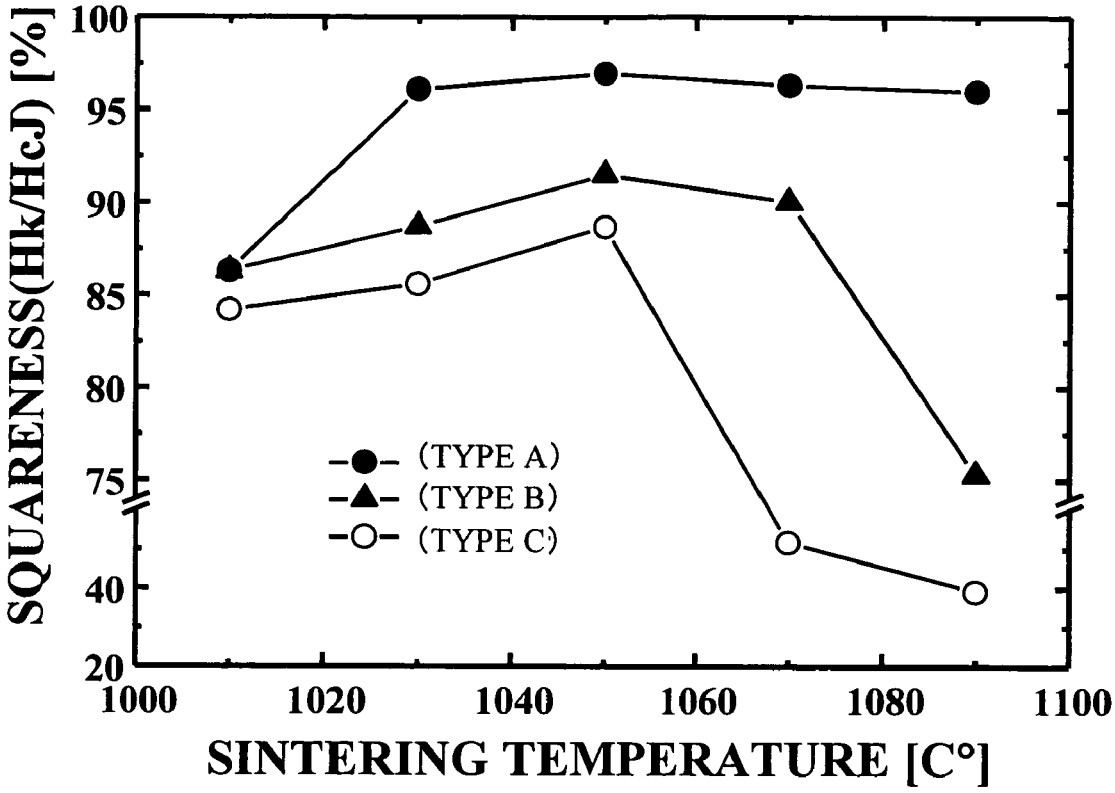
FIG. 18 is a graph showing the relationship between the sintering temperature and the squareness (Hk/HcJ) of the permanent magnets obtained in Example 1.

Subsequently, in reference to FIGS. 15 and 18, when types A, B and C are compared in terms of the squareness (Hk/HcJ), type A has a higher value than types B and C at each of the sintering temperatures. Specifically, a value of 95% or more can be obtained by type A within the sintering temperature range between 1,030° C. and 1,070° C. In contrast, type C has a squareness (Hk/HcJ) of 40% or less at a sintering temperature of 1,090° C., and therefore it cannot be considered that type C is a practical material for industrial production.

From the above descriptions, it can be said that the R-T-B system rare earth permanent magnet of type A has a suitable sintering temperature range of 40° C. or more.

Figure 19:
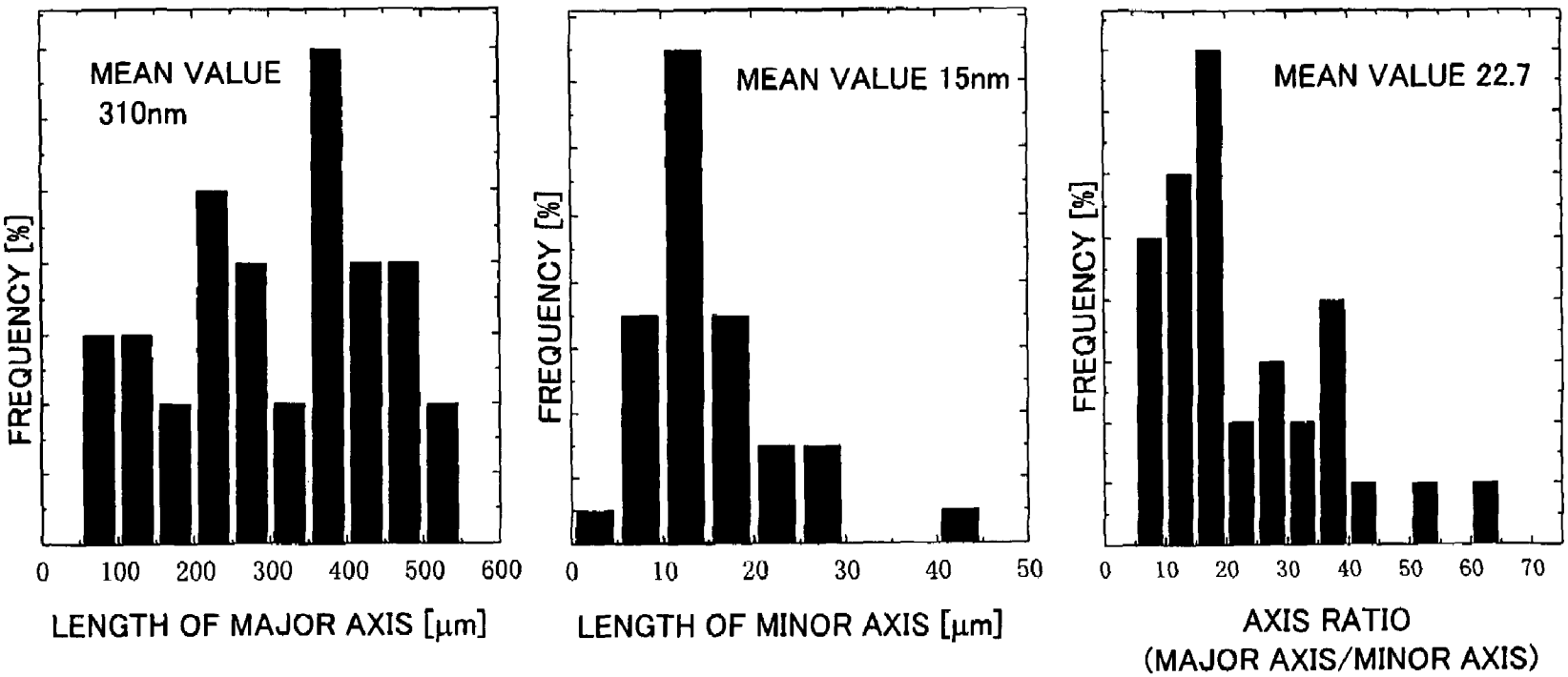
FIG. 19 is a set of graphs showing the measurement results for the product in the permanent magnet of type A obtained in Example 1.
Figure 20:
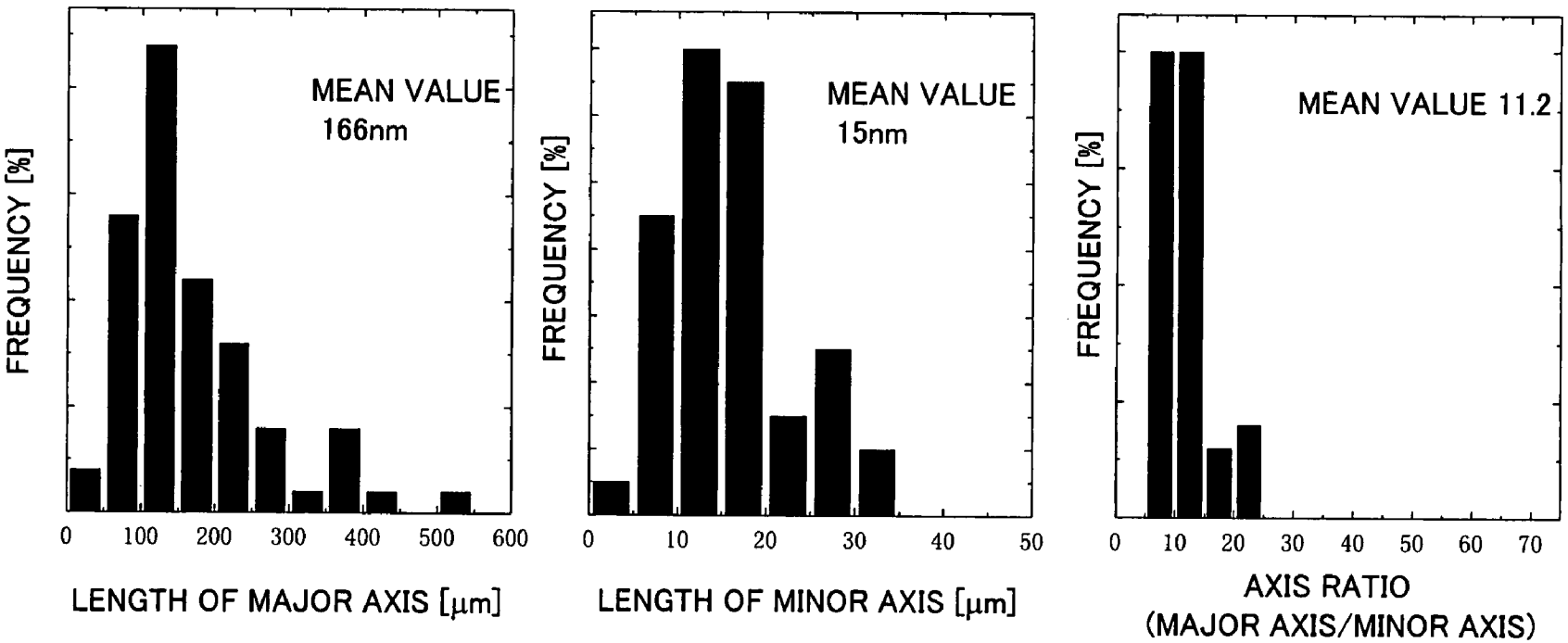
FIG. 20 is a set of graphs showing the measurement results for the product in the permanent magnet of type B obtained in Example 1.

The sizes of the above products in R-T-B system rare earth permanent magnets sintered at 1,050° C. were measured. The measurement results for the product in type A are shown in FIG. 19, and the measurement results for the product in type B are shown in FIG. 20. Moreover, the mean values of the major axis, minor axis, and axis ratio of the products in types A and B are shown in FIG. 15. The samples for the observation were prepared by the ion-milling method, and they were observed by JEM-3010 manufactured by Japan Electron Optics Laboratory Co., Ltd. The axis ratio (major axis/minor axis) exceeds 10 both in types A and B, and thus, it is found that the products have a platy or acicular form with a large axis ratio. Type A in which Zr was added to the low R alloys has a major axis (mean value) of longer than 300 nm and has a high axis ratio of more than 20. No products were observed in type C containing no Zr.

The relationship between the product and magnetic properties will be reviewed. Types A and B each containing the product have a higher coercive force (HcJ) and a higher squareness (Hk/HcJ) than type C containing no products at each of the sintering temperatures. The reason why the coercive force (HcJ) and squareness (Hk/HcJ) of type C are low, is that type C contains abnormally grown coarse crystal grains (constituting an $R_2T_{14}B$ phase) in its sintered microstructure. No such coarse crystal grains were observed in the sintered microstructures of types A and B.

When types A and B both containing the product are compared with each other, type A containing the product having a longer major axis and a larger axis ratio has a higher coercive force (HcJ) and a higher squareness (Hk/HcJ). In addition, type A has a wider suitable sintering temperature range than type B. From these results, the major axis of the product is preferably 200 nm or longer, and more preferably 300 nm or longer. Similarly, the axis ratio is preferably 15 or greater, and more preferably 20 or greater.

Example 2

(1) Mother Alloys

Four types of low R alloys and 2 types of high R alloys shown in FIG. 21 were prepared by the strip casting method.

(2) Hydrogen Crushing Process

A hydrogen crushing treatment was carried out, in which after hydrogen was absorbed into the mother alloys at room temperature, dehydrogenation was carried out thereon at 600° C. for 1 hour in an Ar atmosphere.

To control the amount of oxygen contained in a sintered body to 2,000 ppm or less, so as to obtain high magnetic properties, in the present experiments, the atmosphere was controlled at an oxygen concentration less than 100 ppm throughout processes, from a hydrogen treatment (recovery after a crushing process) to sintering (input into a sintering furnace).

(3) Mixing and Crushing Processes

Before carrying out the pulverizing process, 0.08% butyl oleate was added to the alloys. Thereafter, using a Nauta Mixer, the low R alloys were mixed with the high R alloys for 30 minutes in the combinations of types D to G shown in FIG. 21. In all the types D to G, the mixing ratio between the low R alloys and the high R alloys was 90:10.

Thereafter, the mixture was subjected to the pulverizing with a jet mill to a mean particle size of 4.1 μm.

(4) Compacting Process

The obtained fine powders were compacted in a magnetic field of 17.0 kOe by applying a pressure of 1.2 t/cm$^2$, so as to obtain a compacted body.

(5) Sintering and Aging Processes

The obtained compacted body was sintered at 1,010° C. to 1,090° C. for 4 hours in a vacuum atmosphere, followed by quenching. Thereafter, the obtained sintered body was subjected to a two-step aging treatment consisting of treatments of 800° C.×1 hour and 550° C.×2.5 hours (both in an Ar atmosphere).

The same measurement as in Example 1 was carried out on the obtained permanent magnets. The results are shown in FIG. 22. In all the types D to G (sintering temperature=1,050° C.), the amount of oxygen was 1,000 ppm or less and that of nitrogen was 500 ppm or less. Moreover, a product that was rich in Zr was observed in each of the samples, and the product had a major axis within the range between 250 and 450 nm, a minor axis within the range between 10 and 20 nm, on average. Thus, the axis ratio exceeded 15.

When type D containing 0.11% by weight of Zr is compared with type E containing 0.15% by weight of Zr, the residual magnetic flux density (Br) is equivalent. With regard to the squareness (Hk/HcJ), type E containing a larger amount of Zr has a squareness of 95% or more even at a sintering temperature of 1,090° C. In contrast, the squareness of type D is reduced to 50% or less at the sintering temperature of 1,090° C. Thus, it can be confirmed that Zr can inhibit the abnormal crystal grain growth.

With regard to the value "Br (kG)+0.1×HcJ (kOe), (dimensionless)" that is an index showing the balance of magnet properties, types F and G both containing a larger amount of Dy than type E has a value of 15.6 or greater, which is equivalent to the value of type E. In addition, types F and G have a higher coercive force (HcJ) than type E. This is to say, type F can obtain a value of Br (kG)+0.1×HcJ (kOe)=15.8 and a coercive force (HcJ) of 15.0 kOe or greater within the range of the sintering temperature between 1,030° C. and 1,090° C. Moreover, type G can obtain a value of Br (kG)+0.1×HcJ (kOe)=15.6 and a coercive force (HcJ) of 16.5 kOe or greater within the range of the sintering temperature between 1,030° C. and 1,090° C. Furthermore, type F can obtain a squareness (Hk/HcJ) of 95% or more within the range of the sintering temperature between 1,030° C. and 1,090° C., and type G can obtain the same squareness within the range between 1,030° C. and 1,070° C. Thus, both types F and G have a suitable sintering temperature range of 40° C. or more, and it is found that high magnetic properties can be consistently obtained in a wide sintering temperature range.

Example 3

2 types of low R alloys and 2 types of high R alloys were prepared by the strip casting method. Thereafter, 2 types of R-T-B system rare earth permanent magnets with the combinations as shown in FIG. 23 were obtained. In type H, the mixing ratio between the low R alloys and the high R alloys was 90:10. On the other hand, in type I, the mixing ratio between the low R alloys and the high R alloys was 80:20. The low R alloys and the high R alloys as shown in FIG. 23 were subjected to hydrogen crushing in the same manner as in Example 1. After completion of the hydrogen crushing process, 0.05% by weight of butyl oleate was added thereto. Thereafter, using a Nauta mixer, the low R alloys were mixed with the high R alloys for 30 minutes in the combinations as shown in FIG. 23. Thereafter, the mixture was subjected to the pulverizing with a jet mill to a mean particle size of 4.0 μm. The obtained fine powders were compacted in a magnetic field under the same conditions as in Example 1. Thereafter, in the case of type H, the compacted body was sintered at 1,070° C. for 4 hours, and in the case of type I, it was sintered at 1,020° C. for 4 hours. Thereafter, the obtained sintered bodies of both types H and I were subjected to a two-step aging treatment consisting of treatments of 800° C.×1 hour and 550° C.×2.5 hours. The composition, the amount of oxygen, and the amount of nitrogen of each of the obtained sintered bodies are shown in FIG. 23. In addition, magnetic properties thereof are shown in FIG. 24. For convenience of comparison, the magnetic properties of types D to G prepared in Example 2 are also shown in FIG. 24.

Although the constitutional elements were fluctuated as shown in types D to I, a residual magnetic flux density (Br) of 13.8 kG or greater, a coercive force (HcJ) of 13.0 kOe or greater, and a squareness (Hk/HcJ) of 95% or more were obtained.

INDUSTRIAL APPLICABILITY

As described in detail above, according to the present invention, an R-T-B system rare earth permanent magnet capable of inhibiting the grain growth while keeping a decrease in magnetic properties to a minimum, and improving the suitable sintering temperature range, can be obtained.

What is claimed is:

1. An R-T-B system rare earth permanent magnet, comprising a sintered body comprising:

a main phase consisting of an $R_2T_{14}B$ phase (wherein R represents one or more rare earth elements (providing that the rare earth elements include Y), and T represents one or more transition metal elements essentially containing Fe, or Fe and Co); and a grain boundary phase containing a higher total amount of R than said main phase, wherein a platy or acicular product exists, and wherein said sintered body has a composition consisting essentially of 28% to 33% by weight of R, 0.5% to 1.5% by weight of B, 0.03% to 0.3% by weight of Al, 0.3 or less by weight (excluding 0) of Cu, 0.05% to 0.2% by weight of Zr, 4% or less by weight (excluding 0) of Co, and the balance substantially being Fe.

2. An R-T-B system rare earth permanent magnet according to claim 1, wherein said product exists along said $R_2T_{14}B$ phase.

3. An R-T-B system rare earth permanent magnet according to claim 1 or 2, wherein the mean value of the major axis/minor axis of said product is 5 or greater.

4. An R-T-B system rare earth permanent magnet according to claim 3, wherein the major axis of said product is within the range between 30 and 600 nm and the minor axis thereof is within the range between 3 and 50 nm.

5. An R-T-B system rare earth permanent magnet according to claim 1, wherein said sintered body contains Zr and said product is rich in Zr.

6. An R-T-B system rare earth permanent magnet according to claim 5, wherein said product has periodic composition fluctuations of Zr and R in said minor axis direction.

7. An R-T-B system rare earth permanent magnet according to claim 1, wherein the amount of oxygen contained in said sintered body is 2,000 ppm or less.

8. An R-T-B system rare earth permanent magnet according to claim 1, wherein said sintered body contains 0.1% to 0.15% by weight of Zr.

* * * * *